US009291924B2

(12) United States Patent
Kurimoto et al.

(10) Patent No.: US 9,291,924 B2
(45) Date of Patent: Mar. 22, 2016

(54) ELECTROPHOTOGRAPHIC PHOTOCONDUCTOR, AND IMAGE FORMING METHOD, IMAGE FORMING APPARATUS, AND PROCESS CARTRIDGE USING THE ELECTROPHOTOGRAPHIC PHOTOCONDUCTOR

(71) Applicants: Eiji Kurimoto, Shizuoka (JP); Tetsuro Suzuki, Shizuoka (JP); Tomoharu Asano, Kanagawa (JP); Daisuke Nii, Shizuoka (JP); Toshihiro Ishida, Shizuoka (JP)

(72) Inventors: Eiji Kurimoto, Shizuoka (JP); Tetsuro Suzuki, Shizuoka (JP); Tomoharu Asano, Kanagawa (JP); Daisuke Nii, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/558,061

(22) Filed: Dec. 2, 2014

(65) Prior Publication Data

US 2015/0168856 A1 Jun. 18, 2015

(30) Foreign Application Priority Data

Dec. 13, 2013 (JP) ..... 2013-257871
Oct. 8, 2014 (JP) ..... 2014-207374

(51) Int. Cl.
*G03G 5/14* (2006.01)

(52) U.S. Cl.
CPC ..... *G03G 5/144* (2013.01)

(58) Field of Classification Search
CPC ..... G03G 5/0144; G03G 13/06; G03G 15/00; G03G 21/18; C01G 9/02; C01D 1/02
USPC ..... 430/60, 63, 65, 123.4
See application file for complete search history.

(56) References Cited

U.S. PATENT DOCUMENTS

| | | | | |
|---|---|---|---|---|
| 4,634,650 | A | 1/1987 | Suzuki | |
| 4,672,149 | A | 6/1987 | Yoshikawa et al. | |
| 5,171,480 | A * | 12/1992 | Yoshinaka | H01B 1/20 430/63 |
| 5,350,653 | A | 9/1994 | Shoshi et al. | |
| 5,387,487 | A | 2/1995 | Shoshi et al. | |
| 5,411,827 | A | 5/1995 | Tamura et al. | |
| 5,486,438 | A | 1/1996 | Shoshi et al. | |
| 5,492,784 | A | 2/1996 | Yoshikawa et al. | |
| 5,578,405 | A | 11/1996 | Ikegami et al. | |
| 5,702,855 | A | 12/1997 | Ikegami et al. | |
| 5,723,243 | A | 3/1998 | Sasaki et al. | |
| 5,747,204 | A | 5/1998 | Anzai et al. | |
| 5,830,980 | A | 11/1998 | Anzai et al. | |
| 5,840,454 | A | 11/1998 | Nagai et al. | |
| 5,853,935 | A | 12/1998 | Suzuki et al. | |
| 5,871,876 | A | 2/1999 | Ikuno et al. | |

(Continued)

FOREIGN PATENT DOCUMENTS

| | | |
|---|---|---|
| JP | 56-048637 | 5/1981 |
| JP | 64-001728 | 1/1989 |

(Continued)

*Primary Examiner* — Christopher Rodee
(74) *Attorney, Agent, or Firm* — Oblon, McClelland, Maier & Neustadt, L.L.P.

(57) ABSTRACT

A photoconductor is provided. The photoconductor includes an electroconductive substrate; an intermediate layer located overlying the electroconductive substrate; and a photosensitive layer located overlying the intermediate layer. The intermediate layer includes at least a resin, and a particulate zinc oxide that includes sodium, sulfur and calcium in amounts of from 10 ppm to 200 ppm, from 50 ppm to 500 ppm, and from 10 ppm to 200 ppm, respectively.

9 Claims, 6 Drawing Sheets

(56) References Cited

U.S. PATENT DOCUMENTS

| | | | | |
|---|---|---|---|---|
| 6,018,014 | A | 1/2000 | Nagai et al. | |
| 6,030,733 | A | 2/2000 | Kami et al. | |
| 6,066,428 | A | 5/2000 | Katayama et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,326,112 | B1 | 12/2001 | Tamura et al. | |
| 6,653,033 | B1 | 11/2003 | Kami et al. | |
| 7,295,796 | B1 | 11/2007 | Murakami et al. | |
| 2001/0051307 | A1 | 12/2001 | Ikuno et al. | |
| 2002/0106570 | A1 | 8/2002 | Kami et al. | |
| 2002/0115005 | A1 | 8/2002 | Ikuno et al. | |
| 2003/0073015 | A1 | 4/2003 | Tamoto et al. | |
| 2003/0077531 | A1 | 4/2003 | Suzuki et al. | |
| 2003/0113642 | A1 | 6/2003 | Kami et al. | |
| 2003/0206226 | A1 | 11/2003 | Kurimoto et al. | |
| 2003/0215726 | A1 | 11/2003 | Sugino et al. | |
| 2004/0028435 | A1 | 2/2004 | Kurimoto et al. | |
| 2004/0048178 | A1 | 3/2004 | Ikuno et al. | |
| 2004/0053152 | A1 | 3/2004 | Nagai et al. | |
| 2004/0126139 | A1 | 7/2004 | Yoshizawa et al. | |
| 2004/0126689 | A1 | 7/2004 | Tamoto et al. | |
| 2004/0190936 | A1 | 9/2004 | Yoshiyuki et al. | |
| 2004/0197688 | A1 | 10/2004 | Tamoto et al. | |
| 2004/0248024 | A1 | 12/2004 | Suzuki et al. | |
| 2004/0253527 | A1 | 12/2004 | Suzuki et al. | |
| 2004/0259009 | A1 * | 12/2004 | Itami | G03G 5/10 430/60 |
| 2005/0026058 | A1 | 2/2005 | Kami et al. | |
| 2005/0036810 | A1 | 2/2005 | Murakami et al. | |
| 2005/0053853 | A1 | 3/2005 | Sugino et al. | |
| 2005/0058918 | A1 | 3/2005 | Kurimoto et al. | |
| 2005/0100804 | A1 | 5/2005 | Tamoto et al. | |
| 2005/0105942 | A1 | 5/2005 | Kurimoto et al. | |
| 2005/0106482 | A1 | 5/2005 | Kami et al. | |
| 2005/0118518 | A1 | 6/2005 | Ikegami et al. | |
| 2005/0158641 | A1 | 7/2005 | Yanagawa et al. | |
| 2005/0170272 | A1 | 8/2005 | Suzuki et al. | |
| 2005/0175911 | A1 | 8/2005 | Tamoto et al. | |
| 2005/0196193 | A1 | 9/2005 | Tamoto et al. | |
| 2005/0221210 | A1 | 10/2005 | Suzuki et al. | |
| 2005/0238987 | A1 | 10/2005 | Ohshima et al. | |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2005/0287465 | A1 | 12/2005 | Ohshima et al. | |
| 2006/0014093 | A1 | 1/2006 | Li et al. | |
| 2006/0014096 | A1 | 1/2006 | Ohshima et al. | |
| 2006/0024103 | A1 | 2/2006 | Murakami et al. | |
| 2006/0029427 | A1 | 2/2006 | Yoshizawa et al. | |
| 2006/0051688 | A1 | 3/2006 | Toda et al. | |
| 2006/0051689 | A1 | 3/2006 | Suzuki et al. | |
| 2006/0056893 | A1 | 3/2006 | Kurimoto et al. | |
| 2006/0068308 | A1 | 3/2006 | Ohshima et al. | |
| 2006/0078809 | A1 | 4/2006 | Nagai et al. | |
| 2006/0093955 | A1 | 5/2006 | Ohshima et al. | |
| 2006/0110668 | A1 | 5/2006 | Kawasaki et al. | |
| 2006/0160003 | A1 | 7/2006 | Nagai et al. | |
| 2006/0177749 | A1 | 8/2006 | Tamoto et al. | |
| 2007/0009818 | A1 | 1/2007 | Yanagawa et al. | |
| 2007/0031746 | A1 | 2/2007 | Toshine et al. | |
| 2007/0059039 | A1 | 3/2007 | Shimoyama et al. | |
| 2007/0059618 | A1 | 3/2007 | Kurimoto et al. | |
| 2007/0059619 | A1 | 3/2007 | Shimoyama et al. | |
| 2007/0092290 | A1 | 4/2007 | Murakami et al. | |
| 2007/0122724 | A1 | 5/2007 | Suzuki et al. | |
| 2007/0154825 | A1 | 7/2007 | Tamoto et al. | |
| 2007/0196749 | A1 | 8/2007 | Inaba et al. | |
| 2007/0196750 | A1 | 8/2007 | Fujiwara et al. | |
| 2007/0212625 | A1 | 9/2007 | Suzuki et al. | |
| 2007/0212626 | A1 | 9/2007 | Toshine et al. | |
| 2007/0212627 | A1 | 9/2007 | Yanagawa et al. | |
| 2007/0231720 | A1 | 10/2007 | Mori et al. | |
| 2007/0248901 | A1 | 10/2007 | Shimoyama et al. | |
| 2007/0264047 | A1 | 11/2007 | Kurimoto et al. | |
| 2007/0292780 | A1 | 12/2007 | Nagai et al. | |
| 2008/0020305 | A1 | 1/2008 | Suzuki et al. | |
| 2008/0063959 | A1 | 3/2008 | Nagai et al. | |
| 2008/0085459 | A1 | 4/2008 | Kami et al. | |
| 2008/0113286 | A1 | 5/2008 | Shimoyama et al. | |
| 2008/0138725 | A1 | 6/2008 | Fujiwara et al. | |
| 2008/0153021 | A1 | 6/2008 | Ikuno et al. | |
| 2008/0199217 | A1 | 8/2008 | Iwamoto et al. | |
| 2008/0227008 | A1 | 9/2008 | Kami et al. | |
| 2008/0280221 | A1 | 11/2008 | Shimoyama et al. | |
| 2008/0304867 | A1 | 12/2008 | Nagai et al. | |
| 2008/0305426 | A1 | 12/2008 | Kurimoto et al. | |
| 2008/0311499 | A1 | 12/2008 | Kami et al. | |
| 2009/0035672 | A1 | 2/2009 | Yanagawa et al. | |
| 2009/0067891 | A1 | 3/2009 | Kami et al. | |
| 2009/0068577 | A1 | 3/2009 | Ohta et al. | |
| 2009/0136260 | A1 | 5/2009 | Ikegami et al. | |
| 2009/0148180 | A1 | 6/2009 | Fujiwara et al. | |
| 2009/0180804 | A1 | 7/2009 | Kurimoto et al. | |
| 2009/0311616 | A1 | 12/2009 | Shimoyama et al. | |
| 2010/0209842 | A1 | 8/2010 | Yanagawa et al. | |
| 2010/0233602 | A1 | 9/2010 | Yamamoto et al. | |
| 2010/0260515 | A1 | 10/2010 | Shimoyama et al. | |
| 2010/0290807 | A1 | 11/2010 | Shimoyama et al. | |
| 2011/0020740 | A1 | 1/2011 | Sugino et al. | |
| 2011/0065032 | A1 | 3/2011 | Nagai et al. | |
| 2011/0111335 | A1 | 5/2011 | Shimoyama et al. | |
| 2011/0183255 | A1 | 7/2011 | Kurimoto et al. | |
| 2011/0200926 | A1 | 8/2011 | Tanaka et al. | |
| 2011/0286777 | A1 | 11/2011 | Sugino et al. | |
| 2011/0287353 | A1 | 11/2011 | Horiuchi et al. | |
| 2012/0021346 | A1 | 1/2012 | Nagayama et al. | |
| 2012/0028179 | A1 | 2/2012 | Li et al. | |
| 2012/0052424 | A1 | 3/2012 | Asano et al. | |
| 2012/0087695 | A1 | 4/2012 | Nagai et al. | |
| 2012/0163860 | A1 | 6/2012 | Shimoyama et al. | |
| 2012/0171601 | A1 | 7/2012 | Li et al. | |
| 2012/0183310 | A1 | 7/2012 | Asano et al. | |
| 2012/0183313 | A1 | 7/2012 | Kurimoto et al. | |
| 2013/0011147 | A1 | 1/2013 | Kimura et al. | |
| 2013/0022902 | A1 | 1/2013 | Shimoyama et al. | |
| 2013/0022903 | A1 | 1/2013 | Tanaka et al. | |
| 2013/0059242 | A1 | 3/2013 | Asano et al. | |
| 2013/0059243 | A1 | 3/2013 | Hirose et al. | |
| 2013/0122409 | A1 | 5/2013 | Koizuka et al. | |
| 2013/0122410 | A1 | 5/2013 | Nagai et al. | |
| 2013/0157181 | A1 | 6/2013 | Kurimoto et al. | |
| 2013/0243483 | A1 | 9/2013 | Hirose et al. | |
| 2013/0295496 | A1 | 11/2013 | Tanaka et al. | |
| 2013/0295497 | A1 | 11/2013 | Tanaka et al. | |
| 2013/0330104 | A1 | 12/2013 | Shimoyama et al. | |
| 2014/0178810 | A1 | 6/2014 | Nagai et al. | |
| 2014/0234763 | A1 | 8/2014 | Sugino et al. | |

FOREIGN PATENT DOCUMENTS

| | | | | |
|---|---|---|---|---|
| JP | 4-281461 | | 10/1992 | |
| JP | 5-216249 | | 8/1993 | |
| JP | 8-166679 | | 6/1996 | |
| JP | 11-133649 | | 5/1999 | |
| JP | 2000-066425 | | 3/2000 | |
| JP | 2002-006526 | | 1/2002 | |
| JP | 2006-030700 | | 2/2006 | |
| JP | 2009-075341 | | 4/2009 | |
| JP | 2010-152099 | | 7/2010 | |
| JP | 2011-053592 | | 3/2011 | |
| JP | 2011053592 | A * | 3/2011 | |
| JP | 2012-058597 | | 3/2012 | |
| JP | 2013-072986 | | 4/2013 | |
| WO | WO 2013081170 | A1 * | 6/2013 | G03G 5/142 |

* cited by examiner

ELECTROPHOTOGRAPHIC PHOTOCONDUCTOR, AND IMAGE FORMING METHOD, IMAGE FORMING APPARATUS, AND PROCESS CARTRIDGE USING THE ELECTROPHOTOGRAPHIC PHOTOCONDUCTOR

CROSS-REFERENCE TO RELATED APPLICATIONS

This patent application is based on and claims priority pursuant to 35 U.S.C. §119 to Japanese Patent Applications Nos. 2013-257871 and 2014-207374, filed on Dec. 13, 2013 and Oct. 8, 2014, respectively, in the Japan Patent Office, the entire disclosure of which is hereby incorporated by reference herein.

BACKGROUND

1. Technical Field

This disclosure relates to an electrophotographic photoconductor. In addition, this disclosure relates to an image forming method, an image forming apparatus, and a process cartridge, which use the electrophotographic photoconductor.

2. Description of the Related Art

In an electrophotographic image forming method using an electrophotographic image forming apparatus, an image is formed by performing processes such as a charging process, an irradiating process, a developing process, and a transferring process on an electrophotographic photoconductor (hereinafter referred to as a photoconductor) serving as an electrostatic image carrier or an image carrier. Recently, organic photoconductors using an organic photosensitive material are broadly used as the photoconductor because organic photosensitive materials have a good combination of flexibility, heat stability, and film formability.

Among various organic photoconductors, functionally separated multi-layer photoconductors including an electroconductive substrate, and a photosensitive layer, which is located on the electroconductive substrate and in which a charge generation layer including a charge generating material and a charge transport layer including a charge transport material are laminated, prevail recently. Among various functionally separated multi-layer photoconductors, a number of negatively-chargeable photoconductors, which include a charge generation layer which is a deposited layer of an organic pigment serving as a charge generation material or a layer including a resin and an organic pigment dispersed in the resin, and a charge transport layer in which an organic low molecular weight compound serving as a charge transport material is dispersed in a resin, have been proposed recently. In addition, a technique, in which an intermediate layer (which is sometimes referred to as an undercoat layer) is formed between an electroconductive substrate and a photoconductor to prevent injection of a charge into the photosensitive layer from the electroconductive substrate, is proposed.

Recently, electrophotographic image forming apparatus have been improved to produce high resolution full color images at a high speed, and therefore a need exists for a photoconductor having a good combination of durability and stability. In this regard, when organic photoconductors are used for the current electrophotographic image forming process in which charging and discharging are repeatedly performed, properties of the organic materials constituting the organic photoconductors change due to the electrostatic load on the organic materials, thereby causing a problem in that the electrophotographic properties of the photoconductors deteriorate due to formation of a charge trap in the photosensitive layer, and change of the charging property of the organic materials.

Particularly, when the charging property of organic photoconductors deteriorates due to alteration of the photoconductors, the quality of images produced by the photoconductors seriously deteriorates. Specifically, in this case, image quality problems such that image density decreases; background of images is soiled with toner (hereinafter sometimes referred to as background fog); and the image quality changes when images are continuously produced are caused.

One of the reasons for deterioration of the charging property of organic photoconductors is considered to be deterioration of the intermediate layer of the photoconductors. In general, such an intermediate layer is required to have both a charge injection preventing function to prevent injection of a charge into a photosensitive layer from an electroconductive substrate, and a charge transport function to transport a charge generated in the photosensitive layer to the electroconductive substrate. However, these functions typically establish a trade-off relationship, and in addition organic materials constituting such an intermediate layer tend to deteriorate due to repeated application of electrostatic load thereon. Therefore, it is hard for the intermediate layer to maintain a good combination of the above-mentioned functions over a long period of time.

In attempting to impart a good combination of the functions to an intermediate layer, techniques in that a silane coupling agent including an amino group is used to enhance the charge injection preventing function; and techniques in that an additive such as an electron transport material or an acceptor compound is included in the intermediate layer have been proposed.

The second mentioned techniques include a technique in that an undercoat layer including a particulate metal oxide to which an electron acceptor compound (such as hydroxyanthraquinone compounds and aminohydroxyanthraquinone compounds) is adhered is formed on an electroconductive substrate.

Recently, electrophotographic image forming apparatus have been downsized, and therefore photoconductors used therefor have also be downsized. In addition, a need exists for an image forming apparatus which can produce images at a high speed while being maintenance free. Therefore, a need exists for a photoconductor having good durability.

However, the life of photoconductor also depends on electric properties of the photoconductor, i.e. a charging property in a dark place, and a charge decaying property such that charges on the photoconductor rapidly decay in an irradiating process. Therefore, it is important for photoconductor to maintain a good combination of the charging property and the charge decaying property over a long period of time to prolong the life thereof.

As mentioned above, the intermediate layer is required to maintain both the charge injection preventing function and the charge transport function over a long period of time. However, in general, the number of traps in the intermediate layer, which inhibit flow of charges through the layer, increases when the photoconductor is repeatedly used over a long period of time, thereby increasing the potential of an irradiated portion of the photoconductor. In this case, the contrast between the potential of a non-irradiated portion (i.e., a dark portion) of the photoconductor and the potential of the irradiated portion decreases, thereby decreasing the image density, resulting in shortening of the life of the photoconductor.

Since the outermost layer of organic photoconductor typically includes a low molecular weight charge transport material and an inert polymer as main components, the outermost layer is typically soft. Therefore, when such an organic photoconductor is repeatedly subjected to electrophotographic processes (such as charging, irradiating, developing, transferring, cleaning and discharging processes), the organic photoconductor tends to cause problems such that the outermost layer is easily abraded due to mechanical loads applied in the developing process and the cleaning process.

When the photoconductor is excessively abraded, the potential of an irradiated portion of the photoconductor increases, resulting in shortening of the life of the photoconductor. Therefore, photoconductor is required to have small abrasion loss to prevent increase of the potential of an irradiated portion.

Further, in order to produce high quality images, the particle diameter of toner becomes smaller and smaller. In this regard, it becomes hard for a cleaning blade to remove such a toner having a small particle diameter from a photoconductor, and therefore, recently, the hardness (rubber hardness) and contact pressure of the cleaning blade are increased, resulting in acceleration of abrasion of the photoconductor. Abrasion of photoconductor deteriorates the photosensitivity and electric properties such as charging property of the photoconductor, thereby forming low density images and abnormal images such as background fog.

In addition, when a scratch (i.e., local abrasion) is formed on the surface of the photoconductor, the surface of the photoconductor is defectively cleaned, thereby forming an abnormal streak image. Therefore, not only abrasion but also such a scratch shortens the life of the photoconductor.

In attempting to enhance the abrasion resistance of photoconductor (photosensitive layer), the following technics (1) to (3) have been proposed.

(1) A curable binder resin is used for the outermost layer;

(2) A charge transport polymer is used for the outermost layer; and (3) An inorganic filler is included in the outermost layer.

In addition, a photoconductor having an outermost layer including an electroconductive filler is proposed to improve the electric property of the photoconductor.

Further, there is a proposal such that a charge transport layer is formed by curing a monomer having a carbon-carbon double bond, a charge transport material having a carbon-carbon double bond, and a binder resin. The binder resin includes a resin which has a carbon-carbon double bond and which can be reacted with the charge transport material, and another resin which has no carbon-carbon double bond and which cannot be reacted with the charge transport material.

Furthermore, there is a proposal for a photosensitive layer including a cured material obtained by curing a positive hole transport compound having two or more chain polymerizable functional groups in one molecule thereof.

SUMMARY

As an aspect of this disclosure, a photoconductor is provided which includes an electroconductive substrate, an intermediate layer located overlying the electroconductive substrate, and a photosensitive layer located overlying the intermediate layer, wherein the intermediate layer includes at least a resin, and a particulate zinc oxide that includes sodium, sulfur and calcium in amounts of from 10 ppm to 200 ppm, from 50 ppm to 500 ppm, and from 10 ppm to 200 ppm, respectively.

As another aspect of this disclosure, an image forming method is provided which includes charging a surface of the above-mentioned photoconductor; irradiating the charged surface of the photoconductor with light to form an electrostatic latent image on the surface of the photoconductor; developing the electrostatic latent image with a developer including a toner to form a toner image on the surface of the photoconductor; and transferring the toner image onto a recording medium.

As another aspect of this disclosure, an image forming apparatus is provided which includes the above-mentioned photoconductor; a charger to charge a surface of the photoconductor; an irradiator to irradiate the charged surface of the photoconductor with light to form an electrostatic latent image on the surface of the photoconductor; a developing device to develop the electrostatic latent image with a developer including a toner to form a toner image on the surface of the photoconductor; and a transferring device to transfer the toner image onto a recording medium.

As another aspect of this disclosure, a process cartridge is provided which includes the above-mentioned photoconductor; and at least one of a charger to charge a surface of the photoconductor, an irradiator to irradiate the charged surface of the photoconductor with light to form an electrostatic latent image on the surface of the photoconductor, a developing device to develop the electrostatic latent image with a developer including a toner to form a toner image on the surface of the photoconductor, a transferring device to transfer the toner image onto a recording medium, a cleaner to clean the surface of the photoconductor after the toner image is transferred to the recording medium, and a discharger to remove residual charges from the surface of the photoconductor after the toner image is transferred to the recording medium. The process cartridge is detachably attachable to an image forming apparatus as a single unit.

The aforementioned and other aspects, features and advantages will become apparent upon consideration of the following description of the preferred embodiments taken in conjunction with the accompanying drawings.

DETAILED DESCRIPTION

Figure 1:
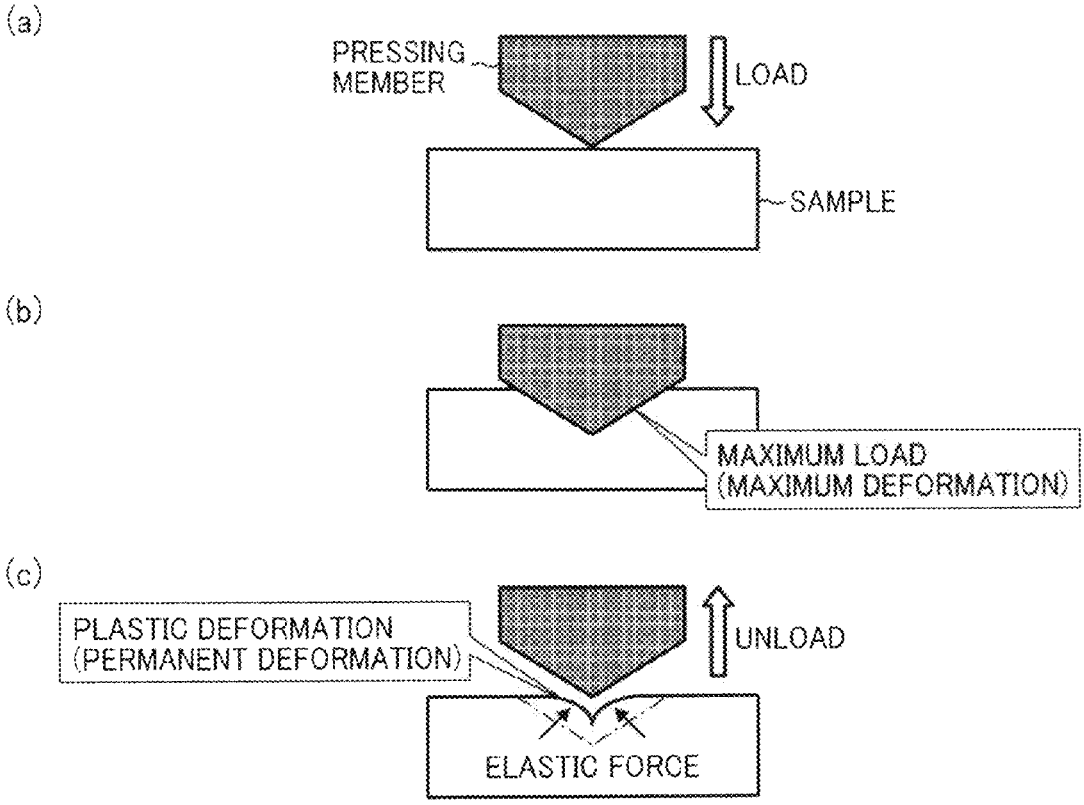
FIG. 1 is a schematic view for describing the method for measuring the elastic deformation rate ($\tau e$) of a layer using a micro surface hardness tester.

As a result of the present inventors' investigation, it is found that the photoconductor mentioned above, which includes an undercoat layer formed on an electroconductive substrate and including a particulate metal oxide to which an electron acceptor compound (such as hydroxyanthraquinone compounds and aminohydroxyanthraquinone compounds) is adhered, has a drawback such that since the hydroxyanthraquinone compounds and aminohydroxyanthraquinone compounds have high crystallinity, the particulate metal oxide, to which the compounds adhere, tend to aggregate, thereby forming an undercoat layer in which the particulate metal oxide is unevenly dispersed, and therefore the photoconductor has insufficient stability of electric property when the photoconductor is used over a long period of time.

In the technique (1) mentioned above in which a curable binder resin is used for the outermost layer, the cured binder resin has poor compatibility with a charge transport material, and therefore impurities such as a polymerization initiator and an unreacted reactive group (residual group) included in the outermost layer increase the residual potential (i.e., potential of an irradiated portion), and thereby low density images tend to be formed by the photoconductor.

In the technique (2) mentioned above in which a charge transport polymer is used for the outermost layer, the abrasion resistance of the photoconductor can be improved to an extent, but the durability of the photoconductor is not sufficient to satisfy the desired durability. In addition, it is hard to produce a high-grade charge transport polymer because polymerization and refinement of such a polymer is difficult, and therefore, the electric property of the charge transport polymer tends to vary. Further, the coating liquid has a high viscosity. Thus, the technique (2) tends to cause production problems.

In the technique (3) mentioned above in which an inorganic filler is included in the outermost layer, the resultant photoconductor has relatively good durability compared with conventional photoconductors having an outermost layer in which a low molecular weight charge transport material is dispersed in an inert polymer. However, the photoconductor has a relatively high residual potential due to trap sites present on the surface of the inorganic filler, and thereby low density images tend to be formed. Further, when the difference in height between the filler portion and the binder resin portion in the outermost layer is large, defective cleaning tends to be caused, resulting in occurrence of a toner filming problem in that a film of toner is formed on the photoconductor and formation of blurred images.

Thus, it is hard for these technics (1)-(3) to satisfactorily enhance the overall durability (i.e., a combination of electrical durability and mechanical durability) of photoconductor.

The above-mentioned photoconductor having a protective layer including an electroconductive filler hardly causes the residual potential increasing problem even when the photoconductor is used over a long period of time. However, since the protective layer has a low electric resistance, image problems such that resolution of images deteriorates and blurred images are formed tend to be caused under high humidity conditions.

In addition, the photoconductor whose charge transport layer is formed by curing a monomer having a carbon-carbon double bond, a charge transport material having a carbon-carbon double bond, and a binder resin has a relatively good combination of abrasion resistance and electric properties. However, when a resin having no reactivity is used as the binder resin, the resin has poor compatibility with a cured material of the monomer and the charge transport material, thereby causing phase separation in the outermost layer (i.e., charge transport layer), resulting in formation of a portion having a poor abrasion resistance in the outermost layer. In this case, problems such that the surface of the photoconductor corresponding to the portion is scratched, and the external additive of the toner and dusts of recording paper fixedly adheres to the portion are caused. In addition, since the outermost layer has uneven light transmission due to the phase separation, omissions (white spots) can form in images.

In addition, the binder resin prevents curing of the monomer. Further, the specific monomers described in the proposal are difunctional monomers, and therefore the resultant layer has insufficient crosslinkage density. Therefore, the durability of the photoconductor is not sufficient to satisfy the desired durability.

Even when a resin having a reactivity is used as the binder resin, it is hard for the layer to enhance the crosslinkage density (due to the difunctional monomer used) while increasing the amount of the charge transport material. Therefore, the electric properties and the abrasion resistance of the photoconductor are not sufficient.

The above-mentioned photosensitive layer including a cured material obtained by curing a positive hole transport compound having two or more chain polymerizable functional groups in one molecule thereof has high crosslinkage density, and therefore has high hardness. However, since a bulky hole transport compound having two or more chain polymerizable functional groups is used, the cured material tends to have distortion and the curing reaction becomes uneven, and thereby the resilience of the photosensitive layer against an external stress is deteriorated locally, resulting in occurrence of problems in that the surface of the photosensitive layer is cracked or scratched by an external stress such as adhesion of carrier particles of the developer.

The object of this disclosure is to provide a photoconductor, which hardly increases the potential of an irradiated portion even after long repeated use and therefore can stably produce high quality images without causing image quality problems which are caused by increase of the potential of the irradiated portion and in which image density decreases; background of images is soiled with toner (i.e., background fog); and the image quality changes when images are continuously produced.

The photoconductor of this disclosure includes an electroconductive substrate, an intermediate layer located overlying the electroconductive substrate, and a photosensitive layer located overlying the intermediate layer, wherein the intermediate layer includes at least a resin and a particulate zinc oxide, which includes sodium, sulfur and calcium in amounts of from 10 ppm to 200 ppm, from 50 ppm to 500 ppm, and from 10 ppm to 200 ppm, respectively. In this regard, "overlying" can include direct contact and allow for one or more interlayers.

The particulate zinc oxide is preferably treated with a silane coupling agent. The silane coupling agent preferably includes an amino group.

The intermediate layer preferably has a film thickness of not less than 10 μm and less than 50 μm.

The particulate zinc oxide preferably has a volume average primary particle diameter of from 20 nm to 200 nm.

The outermost layer (such as a protective layer) of the photoconductor includes a crosslinked material including at least a unit of a radically polymerizable tri- or more-functional monomer having no charge transport structure and another unit of a radically polymerizable monofunctional compound having a charge transport structure, wherein the outermost layer has an elastic deformation rate (τe) of not less than 35%, and the standard deviation of the elastic deformation rate (τe) is not greater than 2%.

The image forming method of this disclosure includes charging a surface of the above-mentioned photoconductor; irradiating the charged surface of the photoconductor with light to form an electrostatic latent image on the surface of the photoconductor; developing the electrostatic latent image with a developer including a toner to form a toner image on the surface of the photoconductor; and transferring the toner image onto a recording medium.

The image forming apparatus of this disclosure includes the above-mentioned photoconductor; a charger to charge a surface of the photoconductor; an irradiator to irradiate the charged surface of the photoconductor with light to form an electrostatic latent image on the surface of the photoconductor; a developing device to develop the electrostatic latent image with a developer including a toner to form a toner image on the surface of the photoconductor; and a transferring device to transfer the toner image onto a recording medium.

The process cartridge of this disclosure includes the above-mentioned photoconductor; and at least one of a charger to charge a surface of the photoconductor, an irradiator to irradiate the charged surface of the photoconductor with light to form an electrostatic latent image on the surface of the photoconductor, a developing device to develop the electrostatic latent image with a developer including a toner to form a toner image on the surface of the photoconductor, a transferring device to transfer the toner image onto a recording medium, a cleaner to clean the surface of the photoconductor after the toner image is transferred to the recording medium, and a discharger to remove residual charges from the surface of the photoconductor after the toner image is transferred to the recording medium.

Initially, the photoconductor of this disclosure will be described. The structure of examples of the photoconductor is described in FIGS. 3-6.

Figure 3:
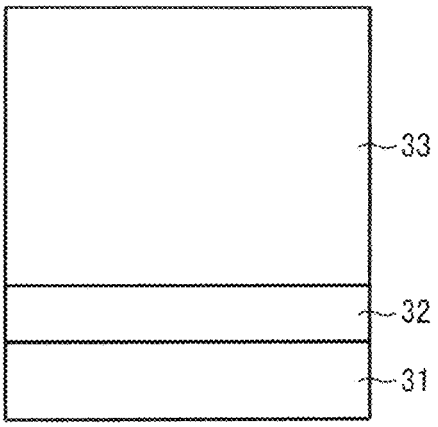
FIG. 3 is a schematic cross-sectional view illustrating an example of a photoconductor according to an embodiment.

FIG. 3 is a schematic cross-sectional view illustrating an example of the photoconductor of this disclosure. The photoconductor includes an electroconductive substrate 31, an intermediate layer 32, which is the above-mentioned intermediate layer and which is located on the electroconductive substrate 31, and a photosensitive layer 33, which is located on the intermediate layer 32 and which includes a charge generation material and a charge transport material as main components.

Figure 4:
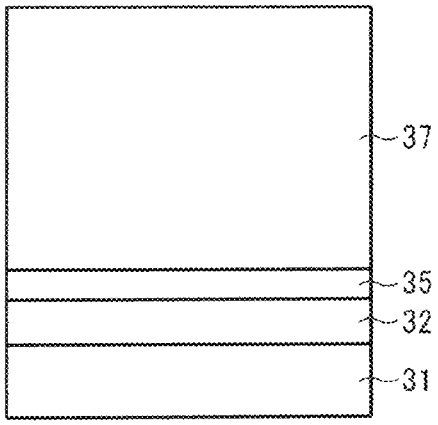
FIG. 4 is a schematic cross-sectional view illustrating another example of the photoconductor.

FIG. 4 is a schematic cross-sectional view illustrating another example of the photoconductor of this disclosure. The photoconductor includes the electroconductive substrate 31, the intermediate layer 32 located on the electroconductive substrate 31, a charge generation layer 35, which is located on the intermediate layer 32 and which includes a charge generation material as a main component, and a charge transport layer 37, which is located on the charge generation layer 35 and which includes a charge transport material as a main component. In this regard, the charge generation layer 35 and the charge transport layer serve as a photosensitive layer.

Figure 5:
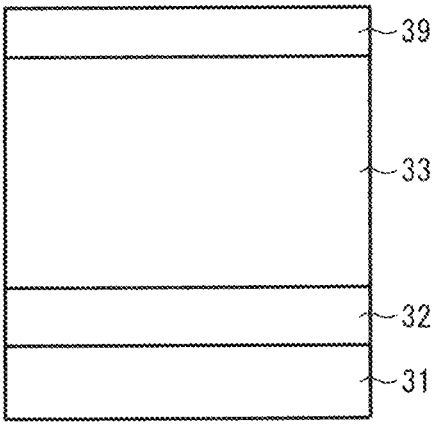
FIG. 5 is a schematic cross-sectional view illustrating another example of the photoconductor.

FIG. 5 is a schematic cross-sectional view illustrating another example of the photoconductor of this disclosure. The photoconductor includes the electroconductive substrate 31, the intermediate layer 32 located on the electroconductive substrate 31, the photosensitive layer 33 located on the intermediate layer 32, and a protective layer 39 which is located on the photosensitive layer 33 to protect the photosensitive layer.

Figure 6:
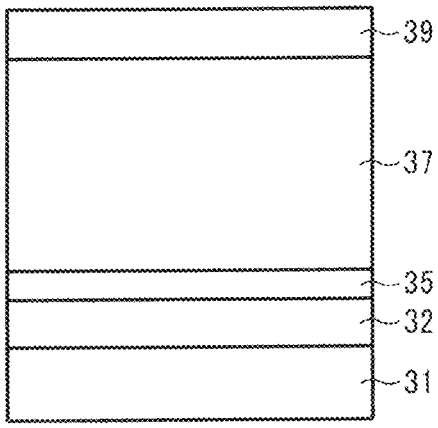
FIG. 6 is a schematic cross-sectional view illustrating another example of the photoconductor.

FIG. 6 is a schematic cross-sectional view illustrating another example of the photoconductor of this disclosure. The photoconductor includes the electroconductive substrate 31, the intermediate layer 32 located on the electroconductive substrate 31, the charge generation layer 35 located on the intermediate layer 32, the charge transport layer 37 located on the charge generation layer 35, and the protective layer 39 located on the charge transport layer 37.

Next, the electroconductive substrate 31 will be described in detail.

Suitable materials for use as the electroconductive substrate include materials having a volume resistivity of not greater than $1\times10^{10}$ Ω·cm. Specific examples of such materials include plastic cylinders, plastic films or paper sheets, on the surface of which a layer of a metal such as aluminum, nickel, chromium, nichrome, copper, gold, silver, and platinum, or a metal oxide such as tin oxides, and indium oxides, is formed using a deposition or sputtering method. In addition, a plate of a metal such as aluminum, aluminum alloys, nickel and stainless steel can be used as the electroconductive substrate 31. Metal cylinders, which are prepared by tubing a metal such as aluminum, aluminum alloys, nickel and stainless steel by a method such as impact ironing or direct ironing, and then subjecting the surface of the tube to a surface treatment such as cutting, super finishing and polishing, can also be used as the electroconductive substrate 31. Further, endless belts of a metal such as nickel and stainless steel (for example, endless belts disclosed in JP-S52-36016-B) can also be used as the electroconductive substrate 31.

Furthermore, substrates having a structure such that an electroconductive layer including a binder resin and an electroconductive powder is formed on a substrate can be used as the electroconductive substrate 31. Specific examples of such an electroconductive powder include carbon black, acetylene black, powders of metals such as aluminum, nickel, iron, nichrome, copper, zinc and silver, and metal oxides such as electroconductive tin oxides and indium tin oxide (ITO). Specific examples of the binder resin used in combination with the electroconductive powder include known thermoplastic resins, thermosetting resins (heat curable (cured) resins) and light curable (cured) resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, and alkyd resins.

Such an electroconductive layer can be formed by coating a coating liquid, which is prepared by dispersing an electroconductive powder in a binder resin dissolved in a proper organic solvent such as tetrahydrofuran, dichloromethane, methyl ethyl ketone and toluene, and then drying the coated liquid.

Further, cylindrical substrates covered with a heat-shrinking tube in which a particulate electroconductive material is dispersed can also be used as the electroconductive layer. Specific examples of the resin constituting the heat-shrinking tube include polyvinyl chloride, polypropylene, polyester, polystyrene, polyvinylidene chloride, polyethylene, chlorinated rubbers, and TEFLON.

Next, the intermediate layer 32 of the photoconductor of this disclosure will be described in detail.

The intermediate layer 32 is prepared by applying a coating liquid, which is prepared by dispersing a particulate zinc oxide, which includes specific elements in specific amounts, in a resin solution or dispersion of a solvent, on the electroconductive substrate 31; and then drying the coated liquid.

It is preferable for the intermediate layer 32 to have both a function to prevent injection of a charge (i.e., a charge with a polarity opposite to that of a charge formed on the photoconductor by a charger) into the photosensitive layer (the photosensitive layer 32 or the combination of the charge generation layer 35 and the charge transport layer 37) from the electroconductive substrate 31, and a function to transport a charge, which has the same polarity as that of the charge formed on the photoconductor by a charger and which is one of the charges formed in the photosensitive layer. Specifically, when the photoconductor is negatively charged in the charging process, the intermediate layer preferably has both a function (hereinafter referred to as a hole blocking function) to prevent injection of positive holes into the photosensitive layer from the electroconductive substrate 31, and a function (hereinafter referred to as an electron transportability) to transport electrons from the photosensitive layer to the electroconductive substrate 31. In addition, in order that the photoconductor maintains good stability over a long period of time, it is preferable that these properties (functions) of the intermediate layer hardly change even when the photoconductor is repeatedly loaded electrostatically.

As a result of the present inventors' investigation to solve the problems, it is found that by using a particulate zinc oxide, which includes specific elements in specific amounts, for the intermediate layer, the intermediate layer can stably maintain good electron transport function over a long period of time. Specifically, it is found that by using a particulate zinc oxide, which includes sodium, sulfur and calcium in amounts of from 10 ppm to 200 ppm, from 50 ppm to 500 ppm, and from 10 ppm to 200 ppm, respectively, for the intermediate layer, the resultant photoconductor can stably maintain good photoconductor function over a long period of time.

Specifically, by including such metal elements in zinc oxide in proper amounts, so-called "dopant effect" can be produced, and thereby an excellent electron transport property, which a general high grade zinc oxide never has, can be imparted to the zinc oxide. By using such a zinc oxide for the intermediate layer, the intermediate layer can have an extremely high level of hole blocking function and electron transportability.

When the content of sodium is less than 10 ppm, it is hard for the intermediate layer to stably maintain good electron transportability over a long period of time. Therefore, the photoconductor using the intermediate layer has a drawback in that the potential of an irradiated portion of the photoconductor gradually increases when the photoconductor is used over a long period of time. In contrast, when the content of sodium is greater than 200 ppm, the charging property of the photoconductor deteriorates after long repeated use although the electron transportability of the photoconductor does not deteriorate.

It is essential that the content of sodium in zinc oxide is from 10 ppm to 200 ppm, and the content is preferably from 30 ppm to 150 ppm, more preferably from 50 ppm to 100 ppm, and even more preferably from 60 ppm to 90 ppm.

When the content of sulfur is less than 50 ppm, it is hard for the intermediate layer to stably obtain good electron transportability. Therefore, the photoconductor using the intermediate layer has a drawback in that the potential of an irradiated portion of the photoconductor is high. In contrast, when the content of sulfur is greater than 500 ppm, the charging property of the photoconductor deteriorates after long repeated use although the electron transportability of the photoconductor does not deteriorate.

It is essential that the content of sulfur in zinc oxide is from 50 ppm to 500 ppm, and the content is preferably from 100 ppm to 400 ppm, more preferably from 150 ppm to 300 ppm, and even more preferably from 170 ppm to 280 ppm.

When the content of calcium is less than 10 ppm, it is hard for the intermediate layer to stably obtain good electron transportability. Therefore, the photoconductor using the intermediate layer has a drawback in that the potential of an irradiated portion of the photoconductor is high, and increases after long repeated use. In contrast, when the content of calcium is greater than 200 ppm, the charging property of the photoconductor deteriorates after long repeated use although the electron transportability of the photoconductor does not deteriorate.

It is essential that the content of calcium in zinc oxide is from 10 ppm to 200 ppm, and the content is preferably from 20 ppm to 150 ppm, more preferably from 30 ppm to 90 ppm, and even more preferably from 50 ppm to 70 ppm.

It is preferable that sodium, sulfur and calcium are included in a particulate zinc oxide substantially uniformly. In this regard, there is no limitation on the form and state of the elements in the particulate zinc oxide.

Any known methods can be used for preparing a particulate zinc oxide including sodium, sulfur and calcium in such amounts as mentioned above. Among various methods, wet methods are preferable. Specific examples of the wet methods include a method including neutralizing an aqueous solution of a zinc compound (typically, a zinc salt) such as zinc sulfate and zinc chloride with a soda ash solution to prepare zinc carbonate, washing the zinc carbonate with water, drying the zinc carbonate, and calcining the zinc carbonate to prepare zinc oxide; and a method including preparing zinc hydroxide, washing the zinc hydroxide with water, drying the zinc hydroxide, and calcining the zinc hydroxide to prepare zinc oxide.

By using such wet methods, it becomes possible to intentionally vary the contents of the specific elements by properly selecting raw materials and properly setting the preparation conditions. Therefore, such a zinc oxide as mentioned above can be easily prepared.

Hereinafter, a wet method will be described in detail.

Initially, an aqueous Zn-containing solution (such as aqueous solutions of the below-mentioned Zn-containing compounds) is mixed with an aqueous alkali solution to obtain a precipitate. After the precipitate is aged and washed, the precipitate is wet with an alcohol to start drying the precipitate, thereby preparing a precursor of a particulate zinc oxide. Next, the precursor is calcined to prepare a particulate zinc oxide.

In this regard, the Zn-containing compound used for preparing the aqueous Zn-containing solution is not particularly limited, and for example, zinc nitrate, zinc chloride, zinc acetate, and zinc sulfate can be used. Since the particulate zinc oxide used for the intermediate layer includes sulfur, zinc sulfate, which includes sulfur, is preferably used as the Zn-containing compound.

Specific examples of the aqueous alkali solution include aqueous solutions of sodium hydroxide, calcium hydroxide, ammonium hydrogen carbonate, and ammonia. Among these aqueous alkali solutions, mixtures of aqueous solutions of sodium hydroxide, ammonium hydrogen carbonate, and calcium hydroxide are preferable for preparing the particulate zinc oxide for use in the intermediate layer.

The amount of sodium hydroxide included in the aqueous alkali solution is preferably from 1.0 to 1.5 times the chemical equivalent weight of sodium hydroxide needed for preparing zinc hydroxide from the Zn-containing compound used. The amount of calcium hydroxide is determined based on the targeted ratio of Na to Ca in the particulate zinc oxide to be prepared.

When the amount of alkali is not less than the chemical equivalent weight, the reaction of the Zn-containing compound can be completely performed. In addition, when the amount is not greater than 1.5 times the chemical equivalent weight, the washing time taken for washing the resultant precipitate to remove residual alkali can be shortened.

Next, formation and aging of the precipitate will be described in detail.

Formation of the precipitate can be performed by dropping the aqueous solution of the Zn-containing compound into the aqueous alkali solution, which is continuously agitated. By dropping the aqueous solution of the Zn-containing compound into the aqueous alkali solution, the aqueous solution becomes supersaturated at once, resulting in formation of the precipitate. Therefore, a particulate material (i.e., a mixture of zinc carbonate and zinc hydroxide carbonate), which has a sharp particle diameter distribution, can be obtained.

When a method in which the aqueous alkali solution is dropped into the aqueous solution of the Zn-containing compound or a method in which both the aqueous solution of the Zn-containing compound and the aqueous alkali solution are dropped in parallel to prepare a mixture is used, such a precipitation as mentioned above, which has a sharp particle diameter distribution, cannot be obtained.

Although the temperature of the aqueous alkali solution is not particularly limited, the temperature is preferably not higher than 50° C., and more preferably room temperature.

The lower limit of temperature of the aqueous alkali solution is not particularly limited. However, when the temperature is too low, a cooler is necessary for maintaining the temperature. Therefore, the lower limit of temperature of the aqueous alkali solution is preferably a temperature at which it is not necessary to use such a cooler.

The drop time taken for dropping the aqueous solution of the Zn-containing compound into the aqueous alkali solution is generally shorter than 30 minutes from the viewpoint of productivity, and is preferably not longer than 20 minutes and more preferably not longer than 10 minutes.

After completing the dropping operation, the system (mixture) is continuously agitated to homogenize the mixture and to age the mixture. The temperature of the aging is generally the same as the above-mentioned temperature at which the precipitation is formed.

The agitation time is not particularly limited, and is generally not longer than 30 minutes from the viewpoint of productivity, and is preferably not longer than 15 minutes.

The precipitate prepared by the aging is washed by a decantation method. In this regard, by checking the electroconductivity of the fluid used for washing the precipitate, it becomes possible to control the amount of sulfate ion remaining in the particulate material, namely it becomes possible to control the amounts of sodium, sulfur and calcium in the final product (zinc oxide).

Next, the washed precipitate is wet with an alcohol solution, and the wet precipitate is dried to prepare a precursor of a particulate zinc oxide. By subjecting the precipitate to such a wetting treatment, aggregation of particles of the precursor can be avoided.

The content of alcohol in the alcohol solution is preferably not less than 50% by weight, so that aggregate in which the particles of the resultant zinc oxide strongly aggregate is not formed, and the resultant zinc oxide can have good dispersibility.

The alcohol used for the alcohol solution is not particularly limited, but alcohols having a boiling point of not higher than 100° C. are preferable. Specific examples of such alcohols include methanol, ethanol, propanol and tert-butyl alcohol.

The wetting treatment will be described in detail.

In the wetting treatment, the precipitate, which is obtained by filtering, followed by washing, is fed into an alcohol solution while agitating. In this regard, the treating time and the agitating speed are properly determined depending on the amount of the precipitate.

The amount of the alcohol solution is also properly determined so that the precipitate fed into the alcohol solution can be easily agitated while having a proper fluidity.

The agitating time and agitating speed are properly determined so that the washed precipitate, part of which is typically aggregated, can be uniformly dispersed (i.e., the aggregate of the precipitate disappears).

The wetting treatment is generally performed at room temperature. However, if desired, the wetting treatment can be performed at a relatively high temperature at which the alcohol solution is not seriously evaporated. Specifically, the wetting treatment is preferably performed at a temperature not higher than the boiling point of the alcohol. In this case, occurrence of a problem in that the alcohol is seriously lost in the wetting treatment can be prevented, and thereby the effect of the wetting treatment is not produced can be prevented. Namely, it is preferable that the alcohol remains in the wetting treatment, because the effect of the wetting treatment can be produced, and thereby aggregate, in which the particles of the resultant zinc oxide strongly aggregate, is not formed even after the precipitate is dried.

Next, drying of the wet precipitate will be described in detail.

The drying conditions such as drying temperature and time are not particularly limited, and the drying treatment is started by heating the precipitate wet by the alcohol. Since the precipitate does not strongly aggregate when the precipitate has been subjected to the wetting treatment, the drying conditions are properly determined depending on the mount of the precipitate and the drier used for the drying treatment. By performing the drying treatment, a precursor of a particulate zinc oxide, which has been subjected to the wetting treatment, can be obtained.

The precursor is then calcined to prepare a particulate zinc oxide. The calcining treatment is performed in an atmosphere such as air, an inert gas such as nitrogen, argon, and helium, and a mixture gas of an inert gas and a reducing gas such as hydrogen. The lower limit of temperature of the calcining treatment is preferably about 400° C. so that the resultant zinc oxide can have a proper ultraviolet absorbance (ultraviolet shielding property). The treating time is properly determined depending on the amount of the precursor to be treated and the calcining temperature.

The content (weight basis) of sodium and calcium in zinc oxide can be determined by inductively-coupled plasma mass spectrometry (ICP-MS), and the content of sulfur can be determined inductively-coupled plasma atomic emission spectrometry (ICP-AES). Specifically, a sample and an acid are fed into a TEFLON container, and subjected to pressurized acidolysis by irradiating a microwave, followed by addition of ultrapure water thereto so that the sample has a constant volume. The thus prepared sample is subjected to ICP-MS or ICP-AES to determine the quantity (content) of sodium, calcium or sulfur.

The particulate zinc oxide included in the intermediate layer preferably has a volume average primary particle diameter of from 20 nm to 200 nm. When the particle diameter of the particulate zinc oxide is larger than the range, the number of particles in the intermediate layer becomes relatively small. In contrast, when the particle diameter of the particulate zinc oxide is smaller than the range, the number of particles of the particulate zinc oxide in the intermediate layer becomes relatively large. Therefore, when the volume average primary particle diameter is greater than 200 nm, the number of particles of the particulate zinc oxide in the intermediate layer decreases, thereby increasing the inter-particle distance. In this case, negative charges generated by the charge generation material in the photosensitive layer do not easily reach the electroconductive substrate, and charge traps are easily formed, thereby forming abnormal images such as residual images. In contrast, when the volume average primary particle diameter is less than 20 nm, the number of particles of the particulate zinc oxide in the intermediate layer increases, and thereby leak of charges is easily caused, resulting in formation of images with background fog.

The volume average primary particle diameter of a particulate zinc oxide is determined by observing the particulate zinc oxide in the intermediate layer with a transmission electron microscope (TEM) to determine the areas of projected images of randomly chosen 100 particles of the particulate zinc oxide, and calculating the diameters of circles having the same areas as the projected images to determine the volume average primary particle diameter of the particulate zinc oxide.

Two or more particulate zinc oxides, which are subjected to different surface treatments or which have different average particle diameters, can be used for the intermediate layer. In this case, each of the particulate zinc oxides includes sodium, sulfur and calcium in amounts of from 10 ppm to 200 ppm, from 50 ppm to 500 ppm, and from 10 ppm to 200 ppm, respectively.

Any known surface treatment agents can be used for the surface treatment to be performed on the particulate zinc oxide. For example, silane coupling agents, titanate coupling agents, aluminum coupling agents, and surfactants can be used as the surface treatment agent. Among these, silane coupling agents are preferable because of imparting good electrophotographic property to the resultant photoconductor, and silane coupling agents having an amino group are more preferable because of imparting good hole blocking function to the intermediate layer 32.

Any silane coupling agents having an amino group can be used as long as the agents can impart desired electrophotographic property to the photoconductor. Specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(hydroxyethyl)-γ-aminopropyltriethoxysilane, but are not limited thereto.

In addition, two or more kinds of silane coupling agents can be used for the surface treatment. Specific examples of silane coupling agents, which can be used in combination with silane coupling agents having an amino group, include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane and γ-chloropropyltrimethoxysilane, but are not limited thereto.

Any known methods such as dry methods and wet methods can be used for the surface treatment of a particulate zinc oxide.

In a dry surface treatment method, a silane coupling agent, which optionally dissolved in an organic solvent, is dropped into a particulate zinc oxide, which is agitated by a mixer having a large shearing force, or the silane coupling agent or the silane coupling agent solution is sprayed into the agitated particulate zinc oxide together with dry air or a nitrogen gas, thereby making it possible to uniformly treat the surface of the particulate zinc oxide with the silane coupling agent. When the organic solvent solution of a silane coupling agent is dropped or sprayed, the temperature is preferably not higher than the boiling point of the solvent. When the temperature is higher than the boiling point of the solvent, the solvent is evaporated before the zinc oxide is uniformly treated with the silane coupling agent, thereby causing a problem in that the silane coupling agent is solidified locally on the surface of the particulate zinc oxide. After the silane coupling agent is dropped or sprayed, the treated zinc oxide is optionally subjected to a heat treatment (i.e., baking) at a temperature of not lower than 100° C. The temperature and time of the heat treatment are not particularly limited, and are properly determined so that the resultant photoconductor has the desired electrophotographic property.

In a wet surface treatment method, a particulate zinc oxide is dispersed in a solvent using a device such as agitators, supersonic dispersing devices, sand mills, attritors, and ball mills, and a solution of a silane coupling agent is added to the dispersion while agitating or dispersing the mixture, followed by removal of the solvent. The solvent can be removed by filtration or distillation. After removal of the solvent, the treated particulate zinc oxide can be subjected to a heat treatment (i.e., baking) at a temperature of not lower than 100° C. The temperature and time of the heat treatment are not particularly limited, and are properly determined so that the resultant photoconductor has the desired electrophotographic property. In the wet surface treatment method, moisture in the particulate zinc oxide may be removed before adding the surface treatment agent. Specific examples of the moisture removing method include a method in which the particulate zinc oxide is fed to the solvent used for the surface treatment, and the mixture is heated while agitated to remove water (moisture), and a method in which the particulate zinc oxide is fed to the solvent used for the surface treatment, and the mixture is heated so that water (moisture) is removed together with the solvent by azeotropy.

The intermediate layer 32 is formed by applying an intermediate layer coating liquid including an organic solvent, the particulate zinc oxide, and a binder resin, followed by drying to remove the organic solvent, resulting in film formation of the intermediate layer in which the particulate zinc oxide is dispersed in the binder resin. As described later, the photosensitive layer is typically formed on the intermediate layer using an organic solvent. Therefore, resins having good resistance to general organic solvents are preferably used for the binder resin of the intermediate layer. Specific examples of such resins include water-soluble resins such as polyvinyl alcohol, casein and sodium salts of polyacrylic acid; alcohol soluble resins such as nylon copolymers and methoxymethylated nylons; and crosslinking resins capable of forming a three-dimensional network such as polyurethane resins, melamine resins, alkyd-melamine resins, and epoxy resins. These resins can be used alone or in combination. The added amount of the binder resin is generally from 10 to 200 parts by weight, and preferably from 20 to 100 parts by weight, based on 100 parts by weight of the particulate zinc oxide. When the added amount of the binder resin is too small, it is hard to prepare an intermediate layer having good film property. In contrast, when the added amount of the binder resin is too large, it is hard to impart good electron transportability to the resultant intermediate layer. The binder resin can be mixed with the particulate zinc oxide before or after the particulate zinc oxide is subjected to the dispersing treatment.

Specific examples of the organic solvent for use in the intermediate layer coating liquid include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated hydrocarbons such as dichloromethane, dichloroethane, trichloroethane and chlorobenzene; aromatic solvents such as benzene, toluene and xylene; and cellosolves such as methyl cellosolve, ethyl cellosolve, and cellosolve acetate. These solvents can be used alone or in combination.

Any known industrially-used dispersing devices can be used for preparing the intermediate layer coating liquid. Specific examples of such devices include ball mills, sand mills, vibration mills, KD mills (DYNO-MILL), three-roll mills, attritors, pressure-type homogenizers, ultrasonic dispersing devices, etc.

Any known coating methods can be used as the method for applying the intermediate layer coating liquid, and a proper coating method is selected depending on the viscosity of the coating liquid, and the targeted film thickness of the intermediate layer. Specific examples thereof include dip coating methods, spray coating methods, bead coating methods, ring coating methods, etc.

After applying the intermediate layer coating liquid, the coated liquid is optionally heated in an oven or the like to be dried. In this regard, the drying temperature is determined depending on the property (such as boiling point) of the solvent included in the coating liquid, and is preferably from 80° C. to 200° C., and more preferably from 100° C. to 150° C. When the drying temperature is too low, the solvent tends to remain in the resultant intermediate layer. In contrast, when the drying temperature is too high, the organic material (such as binder resin) constituting the intermediate layer tends to deteriorate, and thereby the desired function cannot be imparted to the resultant intermediate layer.

The film thickness of the intermediate layer is determined depending on the desired electrophotographic property and life of the photoconductor, but is preferably not less than 10 μm and less than 50 μm, and more preferably from 15 μm to 30 μm. When the intermediate layer is too thin, charges with a polarity opposite to that of charges formed on the surface of the photoconductor by a charger are injected into the photosensitive layer from the electroconductive substrate, thereby deteriorating the charging property of the photoconductor, resulting in formation of defective images such as background fog. In contrast, when the intermediate layer is too thick, problems such that the potential of an irradiated portion (i.e., residual potential) of the photoconductor increases (i.e., deterioration of photo-decaying property); and the stability of the photoconductor deteriorates after long repeated use tend to be caused.

In order to enhance the electric properties and the stability to withstand environmental conditions of the photoconductor, and the quality of images produced by the photoconductor, various kinds of additives can be added to the intermediate layer coating liquid. Specific examples of the additives include electron transport materials such as quinone compounds (e.g., chloranil and bromanil), tetracyanoquinodimethane compounds, fluorenone compounds (e.g., 2,4,7-trinitrofluorenone and 2,4,5,7-tetranitro-9-fluorenone), oxadiazole compounds (e.g., 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole), xanthone compounds, thiophene compounds, and diphenoquinone compounds (e.g., 3,3',5,5'-tetra-t-butyldiphenoquinone); electron transport pigments such as condensed polycyclic pigments and azo pigments; other compounds such as zirconium chelate compounds, titanium chelate compounds, aluminum chelate compounds, organic titanium compounds, and silane coupling agents.

Silane coupling agents can be used not only as the surface treatment agent for the particulate zinc oxide to be included in the intermediate layer but also as additives to be added to the intermediate layer coating liquid. Specific examples of silane coupling agents to be added to the intermediate layer coating liquid include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, γ-chloropropyltrimethoxysilane, etc.

Specific examples of the zirconium chelate compounds include zirconium butoxide, ethyl acetoacetate zirconium, triethanolamine zirconium, acetylacetonate zirconium butoxide, ethyl acetoacetate zirconium butoxide, zirconium acetate, zirconium oxalate, zirconium lactate, zirconium phosphonate, zirconium octanate, zirconium naththenate, zirconium laurate, zirconium stearate, zirconium isostearate, methacrylate zirconium butoxide, stearate zirconium butoxide, isostearate zirconium butoxide, etc.

Specific examples of the titanium chelate compounds include tetraisopropyl titanate, tetra-n-butyl titanate, butyl titanate dimer, tetra(2-ethylhexyl) titanate, acetylacetonate titanium, acetoacetonate polytitanium, titanium octyleneglycolate, ammonium salt of titanium lactate, titanium lactate, ethyl ester of titanium lactate, titanium triethanolaminate, titanium polyhydroxy stearate, etc.

Specific examples of the aluminum chelate compounds include aluminum isopropylate, monobutoxy aluminum diisopropylate, aluminum butyrate, diethylacetoacetate aluminum diisopropylate, aluminum tris(ethylacetoacetate), etc.

The above-mentioned compounds can be used alone or in combination (such as mixtures and polycondensation compounds thereof).

Next, the photosensitive layer will be described. The photosensitive layer can be a single-layered photosensitive layer (illustrated in FIGS. 3 and 5) or a multi-layered photosensitive layer (illustrated in FIGS. 4 and 6) including a charge generation layer and a charge transport layer. For the convenience of description, the multi-layered photosensitive layer will be described initially.

The charge generation layer 35 includes a charge generation material as a main component. Any known charge generation materials can be used for the charge generation layer 35. Specific examples of such charge generation materials include monazo pigments, disazo pigments, trisazo pigments, perylene pigments, perynone pigments, quinacridone pigments, condensed polycyclic quinone compounds, squaric acid dyes, phthalocyanine pigments, naphthalocyanine pigments, azulenium salt type dyes, etc. These compounds can be used alone or in combination.

The charge generation layer 35 is typically formed by applying a charge generation layer coating liquid, which is prepared by dispersing a charge generation material in a solvent optionally together with a binder resin using a dispersing device such as ball mills, attritors, sand mills, and ultrasonic dispersing devices, on the intermediate layer, and then drying the applied coating liquid.

Specific examples of the optionally-added binder resin include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinylbenzal, polyester, phenoxy resins, vinyl chloride-vinyl acetate copolymers, polyvinyl acetate, polyphenylene oxide, polyvinyl pyridine, cellulose resins, casein, polyvinyl alcohol, polyvinyl pyrrolidone, etc. These resins can be used alone or in combination. The added amount of the binder resin is generally from 0 to 500 parts by weight, and preferably from 10 to 300 parts by weight, based on 100 parts by weight of the charge generation material included in the charge generation layer. In this regard, the binder resin is mixed with the charge generation material before or after the charge generation material is dispersed.

Specific examples of the solvent for use in the charge generation layer coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. Among these solvents, ketone solvents, ester solvents, and ether solvents are preferably used. These solvents can be used alone or in combination.

The charge generation layer coating liquid includes a charge generation material, a solvent, and a binder resin as main components, and can include other components such as sensitizers, dispersants, surfactants, and silicone oils.

Specific examples of the method of applying the charge generation layer coating liquid include dip coating, spray coating, bead coating, nozzle coating, spin coating, ring coating, etc.

The film thickness of the charge generation layer 35 is generally from 0.01 μm to 5 μm, and preferably from 0.1 μm to 2 μm.

The charge transport layer 37 includes a charge transport material as a main component. Any known positive hole transport materials can be used as the charge transport material.

Specific examples of the positive hole transport materials include poly(N-vinylcarbazole) and derivatives thereof, poly(γ-carbazolylethylglutamate) and derivatives thereof, pyrene-formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene derivatives, aminobiphenyl derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These positive hole transport materials can be used alone or in combination.

The charge transport layer is typically prepared by applying a charge transport layer coating liquid, in which a charge transport material and a binder resin are dissolved or dispersed in a solvent, on the charge generation layer, and then drying the applied coating liquid by heating in an oven or the like.

Specific examples of the binder resin for use in the charge transport layer include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylates, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenolic resins, and alkyd resins. Among these resins, polycarbonate and polyarylate are preferable. These resins can be used alone or in combination.

Specific examples of the solvent for use in the charge transport layer coating liquid include tetrahydrofuran, dioxane, toluene, cyclohexane, methyl ethyl ketone, xylene, acetone, diethyl ether, etc. These solvents can be used alone or in combination.

The temperature at which the applied charge transport layer coating liquid is heated to be dried is determined depending on the solvent included in the coating liquid, and is preferably from 80° C. to 150° C., and more preferably from 100° C. to 140° C.

The added amount of the charge transport material is generally from 20 to 300 parts by weight, and preferably from 40 to 150 parts by weight, based on 100 parts by weight of the binder resin.

The charge transport layer coating liquid can optionally include a plasticizer and a leveling agent.

Any known plasticizers for use in resins such as dibutyl phthalate and dioctyl phthalate can be used for the charge transport layer. The added amount of such a plasticizer is generally from 0 to 30 parts by weight based on 100 parts by weight of the binder resin.

Specific examples of the leveling agent for use in the charge transport layer coating liquid include silicone oils such as dimethyl silicone oils, and methyl phenyl silicone oils, polymers or oligomers having a perfluoroalkyl group in a side chain thereof, etc. The added amount of the leveling agent is generally from 0 to 1 part by weight based on 100 parts by weight of the binder resin.

The film thickness of the charge transport layer 37 is generally from 5 μm to 40 μm, and preferably from 10 μm to 30 μm.

Next, the single-layered photosensitive layer 33 (illustrated in FIGS. 3 and 5) will be described in detail.

The single-layered photosensitive layer 33 is typically prepared by applying a photosensitive layer coating liquid, in which a charge generation material, a charge transport material and a binder resin are dissolved or dispersed in a solvent, on the intermediate layer, and then drying the applied coating liquid. The photosensitive layer coating liquid can optionally include a plasticizer, a leveling agent, an antioxidant, etc.

The charge generation materials, the charge transport materials and the binder resins mentioned above for use in the charge generation layer and the charge transport layer can also be used for the single-layered photosensitive layer 33.

The single-layered photosensitive layer 33 preferably includes an electron transport material as a charge transport material to enhance the photosensitivity of the photosensitive layer.

Specific examples of the electron transport materials include known materials having an electron accepting property such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and benzoquinone derivatives. These electron transport materials can be used alone or in combination.

The added amount of the charge generation material in the single-layered photosensitive layer 33 is generally from 0.1% to 30% by weight, and preferably from 0.5% to 5% by weight, based on the total weight of the photosensitive layer. When the added amount is too small, the photosensitivity of the photoconductor tends to deteriorate. In contrast, when the added amount is too large, the charge property and the mechanical strength of the photosensitive layer tend to deteriorate.

The added amount of the charge transport material in the single-layered photosensitive layer 33 is preferably from 30 to 200 parts by weight based on 100 parts by weight of the binder resin included in the photosensitive layer. In addition, the added amount of the electron transport material in the single-layered photosensitive layer 33 is preferably from 30 to 200 parts by weight based on 100 parts by weight of the binder resin included in the photosensitive layer.

The film thickness of the single-layered photosensitive layer 33 is preferably not greater than 50 μm, and more preferably not greater than 25 μm from the viewpoint of resolution of image and photo-response of the photoconductor. The lower limit of the film thickness changes depending on the system for which the photoconductor is used (particularly, the potential of charge to be formed on the photoconductor in the system), but is preferably not less than 5 μm.

The photoconductor of this disclosure optionally includes the protective layer 39 serving as an outermost layer to protect the photosensitive layer. Crosslinkable resins are preferably used for the protective layer 39. More preferably, the protective layer is a crosslinked layer, which is formed by curing a radically polymerizable tri- or more-functional monomer having no charge transport structure and a radically polymerizable monofunctional compound having a charge transport structure and which has an elastic deformation rate (τe) of not less than 35% with a standard deviation of not greater than 2%.

Further, the functional groups of the radically polymerizable tri- or more-functional monomer having no charge transport structure are preferably an acryloyloxy group and/or a methacryloyloxy group.

The ratio (M/F) of the molecular weight (M) of the radically polymerizable tri- or more-functional monomer to the number of functional groups (F) thereof is preferably not greater than 250.

Furthermore, the functional group of the radically polymerizable monofunctional compound having a charge transport structure is preferably an acryloyloxy group or a methacryloyloxy group, and the charge transport structure thereof is a triarylamine structure.

The protective layer 39 is typically prepared by applying a protective layer coating liquid. Any known coating methods such as dip coating, spray coating, bead coating, nozzle coating, spin coating, and ring coating can be used for applying the protective layer coating liquid. Among these coating methods, spray coating is preferable because a layer with good uniformity can be formed thereby.

The radically polymerizable monofunctional compound having a charge transport structure imparts good charge transport property to the crosslinked protective layer (outermost layer). The added amount of such a radically polymerizable monofunctional compound is from 20 to 80% by weight, and preferably from 30 to 70% by weight, based on the total weight of the protective layer. When the added amount is less than 20% by weight, the protective layer has insufficient charge transport property, and the electric properties of the photoconductor (such as photosensitivity and residual potential) deteriorate after long repeated use. In contrast, when the added amount is greater than 80% by weight, the content of the polymerizable tri- or more-functional monomer decreases, and thereby the crosslinkage density decreases, resulting in deterioration of the abrasion resistance of the photoconductor. Since the targeted electric properties and abrasion resistance of a photoconductor change depending on the process (image forming apparatus) for which the photoconductor is used, the added amount of the radically polymerizable monofunctional compound is not unambiguously determined, but is preferably from 30 to 70% by weight based on the total weight of the protective layer in consideration of balance between the electric properties and the abrasion resistance.

The protective layer (outermost layer) is a layer formed by curing a radically polymerizable tri- or more-functional monomer having no charge transport structure and a radically polymerizable monofunctional compound having a charge transport structure. However, in order to adjust the viscosity of the coating liquid, to perform stress relaxation on the protective layer, and to decrease the surface energy and friction coefficient of the protective layer, a radically polymerizable monofunctional monomer, a radically polymerizable difunctional monomer, a functional monomer, and a radically polymerizable oligomer can be used in combination with the monomers.

Any known monomers and oligomers can be used as the radically polymerizable monofunctional monomer, the radically polymerizable difunctional monomer, the functional monomer, and the radically polymerizable oligomer.

Specific examples of such a radically polymerizable monofunctional monomer include 2-ethylhexl acrylate, 2-hydroxyethyl acrylate, 2-hydroxypropyl acrylate, tetrahydrofurfuryl acrylate, 2-ethylhexlcarbitol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, and styrene.

Specific examples of such a radically polymerizable difunctional monomer include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, binsphenol A-ethyleneoxy-modified diacrylate, bisphenol F-ethyleneoxy-modified diacrylate, and neopentylglycol diacryalte.

Specific examples of such a functional monomer include fluorine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates, and methacrylates, which are described in JP-H05-60503-B and JP-H06-45770-B and which have a siloxane group such as siloxane units having a repeat number of from 20 to 70 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl).

Specific examples of the radically polymerizable oligomer include epoxyacrylate oligomers, urethane acrylate oligomers, and polyester acrylate oligomers.

When these radically polymerizable monofunctional or difunctional monomers, functional monomers, and radically polymerizable oligomers are used in a large amount for forming the crosslinked outermost layer, the three-dimensional crosslinkage density of the layer deteriorates, thereby deteriorating the abrasion resistance of the photoconductor. Therefore, the added amount of such a monomer and oligomer is preferably not greater than 50 parts by weight, and more preferably not greater than 30 parts by weight, based on 100 parts by weight of the radically polymerizable tri- or more-functional monomer used for forming the crosslinked outermost layer.

The protective layer (outermost layer) is a layer formed by curing a radically polymerizable tri- or more-functional monomer having no charge transport structure and a radically polymerizable monofunctional compound having a charge transport structure. However, in order to efficiently perform the crosslinking reaction, a polymerization initiator (such as heat polymerization initiators, and photopolymerization initiators) can be optionally used.

Specific examples of the heat polymerization initiators include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexine-3, di-t-butyl peroxide, t-butylhydroperoxide, cumenehydroperoxide and lauroyl peroxide; and azo type initiators such as azobisisobutyronitrile, azobiscyclohexanecarbonitrile, azobisbutyric acid methyl ester, hydrochloric acid salt of azobisisobutylamidine, and 4,4'-azobis-cyanovaleric acid.

Specific examples of the photopolymerization initiators include acetophenone or ketal type photopolymerization initiators such as diethoxyacetophenone, 2,2-dimethoxy-1,2-diphenylethane-1-one, 1-hydroxycyclohexyl phenyl ketone, 4-(2-hydroxyethoxyl)phenyl(2-hydroxy-2-propyl) ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, and imidazole compounds.

Photopolymerization accelerators can be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, and 4,4'-dimethylaminobenzophenone.

These polymerization initiators can be used alone or in combination.

The added amount of such a polymerization initiator is preferably from 0.5 parts to 40 parts by weight, and more preferably from 1 part to 20 parts by weight, per 100 parts by weight of the total weight of the polymerizable compounds used for forming the outermost layer.

The outermost layer coating liquid can optionally include other additives such as plasticizers (used for relaxing stress in the outermost layer while improving the adhesiveness of the outermost layer with the photosensitive layer), leveling agents, and low molecular weight charge transport materials having no radical polymerizing ability. Specific examples of the plasticizers include plasticizers for use in resins such as dibutyl phthalate, and dioctyl phthalate. The added amount of such a plasticizer is generally not greater than 20% by weight, and preferably not greater than 10% by weight, based on the total weight of the solid components (including monomers and compounds used for forming the outermost layer) included in the outermost layer coating liquid.

Specific examples of the leveling agents include silicone oils (such as dimethylsilicone oils, and methylphenylsilicone oils), polymers and oligomers having a perfluoroalkyl group in their side chains. The added amount of such a leveling agent is preferably not greater than 3% by weight based on the total weight of the solid components (including monomers and compounds used for forming the outermost layer) included in the outermost layer coating liquid.

The crosslinked outermost layer is typically formed by applying a coating liquid including at least a radically polymerizable tri- or more-functional monomer having no charge transport structure, and a radically polymerizable monofunctional compound having a charge transport structure, and then curing the coated layer.

When the polymerizable monomer used is a liquid, it is possible to dissolve other components therein when preparing the outermost layer coating liquid.

Since the polymerizable monomer is a liquid. However, the outermost layer coating liquid can be optionally diluted by a solvent.

Specific examples of such a solvent include alcohols such as methanol, ethanol, propanol, and butanol; ketones such as acetone, methyl ethyl ketone, methyl isobutyl ketone, cyclopentanone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; and cellosolves such as methyl cellosolve, ethyl cellosolve, and cellosolve acetate. These solvents can be used alone or in combination. The added amount of such a solvent is properly determined depending on the solubility of the components, coating methods, and the target thickness of the outermost layer.

Specific examples of the coating method used for forming the outermost layer include dip coating, spray coating, bead coating, and ring coating.

After the coating liquid is applied, energy is externally applied to the coated layer to cure the layer, resulting in formation of a crosslinked outermost layer. Specific examples of such energy include heat energy, light energy, and radiation energy.

Specific examples of the method using heat energy include a method in which the coated layer is heated using a heated gas (such as air and nitrogen gas), steam, a heating medium, infrared rays, or electromagnetic waves from the coated layer side or the backside (i.e., the side of the substrate). In this case, the temperature is preferably from 100° C. to 170° C. When the temperature is lower than 100° C., the reaction speed is slow, and the crosslinking reaction cannot be completely performed. In contrast, when the temperature is higher than 170° C., the crosslinking reaction unevenly proceeds, thereby causing a problem in that a large strain is formed in the resultant crosslinked outermost layer. In order to prepare an evenly crosslinked outermost layer, it is preferable to perform first heating at a relatively low temperature of lower than 100° C., followed by second heating at a relatively high temperature of not lower than 100° C. to complete the reaction.

When light energy is used for the crosslinking reaction, UV light sources such as high pressure mercury lamps, and metal halide lamps are preferably used. It is possible to use light sources emitting visible light when the polymerizable compounds and polymerization initiators can absorb visible light. The irradiance is preferably not less than 50 $mW/cm^2$ (50 $mJ/cm^2 \cdot s$) and not greater than 1,000 $mW/cm^2$. When the irradiance is less than 50 $mW/cm^2$, a long time is needed for performing the crosslinking reaction. When the irradiance is greater than 1,000 $mW/cm^2$, the crosslinking reaction is unevenly performed, thereby causing a problem such that wrinkles are partially formed on the outermost layer, thereby seriously roughening the outermost layer.

Specific examples of the radiation energy include electron beam energy. Among these energies, heat energy or light energy is preferable because the reaction speed can be easily controlled, and a simple energy application device can be used therefor.

The preferable thickness of the crosslinked outermost layer changes depending on the layer structure of the photoconductor. Therefore, the preferable thickness will be described later in relation to the layer structure of the photoconductor.

The crosslinked outermost layer has an elastic deformation rate (τe) of not less than 35%, and the standard deviation of the elastic deformation rate (τe) is not greater than 2%.

In this application, the elastic deformation rate (τe) is measured by a loading/unloading test using a micro surface hardness tester having a diamond pressing member.

Figure 2:
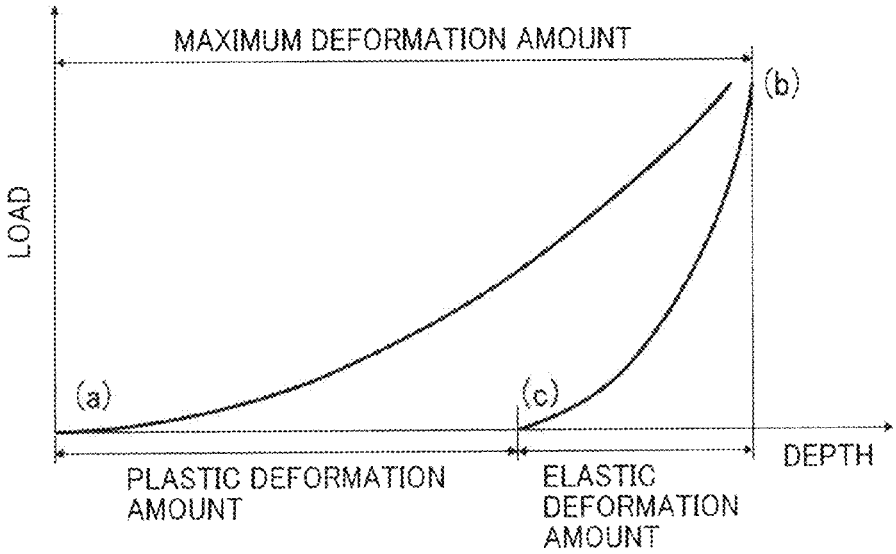
FIG. 2 is a graph showing relation between load to a layer, and plastic deformation amount and elastic deformation amount of the layer.

Specifically, as illustrated in FIG. 1, when the pressing member is contacted with a surface of a sample (i.e., photoconductor) as illustrated in FIG. 1(*a*) (i.e., a point (a) illustrated in FIG. 2), the pressing member is pressed to the sample at a constant loading rate (loading process). When the load reaches the predetermined load, the pressing member is stopped (rested) for a predetermined time at a maximum deformation point (i.e., a point (b) illustrated in FIG. 2) as illustrated in FIG. 1(*b*). Next, the pressing member is drawn up at a constant speed as illustrated in FIG. 1(*c*) (unloading process). In this regard, the point at which the load is not applied to the sample any more is called a plastic deformation point (c) (illustrated in FIG. 2). The relation between the load and the depth of the deformed portion of the sample is illustrated in FIG. 2. The elastic deformation rate (τe) of the sample can be determined by the following equation:

$$\text{Elastic deformation rate}(\tau e)=[(MD-PD)/MD]\times 100$$

wherein MD represents the maximum deformation amount of the sample, and PD represents the plastic deformation amount of the sample, as illustrated in FIG. 2.

This elastic deformation rate measurement is performed under a constant temperature and humidity condition (i.e., 22° C. and 55% RH in this application).

In this application, the elastic deformation rate measurement is performed using a dynamic micro surface hardness tester DUH-201 from Shimadzu Corp., and a pressing member having a triangular pyramid shape with an angle of 115°. However, other instruments can be used as long as the instruments produce similar measurement results.

In this application, the elastic deformation rate (τe) of each of randomly selected 10 points of a sample is measured, and the standard deviation of the elastic deformation rate (τe) is determined based on the 10 data of the elastic deformation rate (τe).

The sample is prepared by forming a photoconductor, which has a crosslinked outermost layer, on an aluminum cylinder, and then cutting the photoconductor. When measuring the elastic deformation rate (τe), the data vary depending on the spring characteristics of the substrate of the photoconductor. Therefore, it is preferable to use a rigid material such as metal plates and slide glass.

In addition, the elastic deformation rate (τe) of the outermost layer varies depending on the hardness and elasticity of the lower layer (e.g., charge transport layer and charge generation layer). Therefore, it is preferable to control the load to control the maximum deformation amount so as to be one tenth (1/10) of the thickness of the outermost layer.

It is not preferable to measure the elastic deformation rate (τe) of an outermost layer directly formed on a substrate. Specifically, when the outermost layer is formed on a lower layer such as charge transport layer, the outermost layer is contaminated with components of the lower layer, the outermost layer is different in composition from the outermost layer directly formed on the substrate. In addition, the adhesiveness of the outermost layer to the lower layer is difference from the adhesiveness of the outermost layer to the substrate. Therefore, the elastic deformation rate (τe) of an outermost layer directly formed on the substrate is different from that of the outermost layer formed on the lower layer.

When the elastic deformation rate (τe) of the crosslinked outermost layer is less than 35%, the outermost layer has poor abrasion resistance. In addition, when the standard deviation thereof is greater than 2%, the outermost layer locally has a weak portion, thereby causing a filming problem in that foreign materials such as toner particles and paper dust fixedly adhere to the weak portion, resulting in formation of a film of the foreign materials.

The elastic deformation rate (τe) of the crosslinked outermost layer and the standard deviation thereof vary depending on the following conditions:

(1) The components included in the outermost layer coating liquid, and the contents thereof;

(2) The solvent used for diluting the outermost layer coating liquid and the solid content of the coating liquid;

(3) The coating method used for forming the outermost layer;

(4) The curing device used for crosslinking the outermost layer, and curing conditions; and (5) The solubility of the lower layer in the outermost layer coating liquid.

These conditions are interrelated.

The outermost layer coating liquid can optionally include a radically polymerizable di- or more-functional compound having a charge transport structure or a binder resin in an amount such that the smoothness of the surface of the photoconductor, and the electric properties and durability of the photoconductor are not deteriorated thereby.

In this regard, when a radically polymerizable di- or more-functional compound having a charge transport structure is used, the crosslinkage density can be enhanced, thereby increasing the elastic deformation rate (τre) of the crosslinked outermost layer. However, the compound, which is bulky, intertwines with each other with a number of bonds therebetween, resulting in occurrence of an uneven curing reaction, thereby forming a distorted crosslinked outermost layer.

Therefore, the resilience of the photosensitive layer against an external stress is deteriorated locally, and the standard deviation of the elastic deformation rate (τe) increases.

When a polymer material such as binder resins is included in the outermost coating liquid, the polymer material tends to have poor compatibility with the polymer produced by a curing reaction of radically polymerizable components (i.e., a radically polymerizable tri- or more-functional monomer and a radically polymerizable monofunctional compound), thereby causing phase separation in the coated outermost layer coating liquid, resulting in increase of the standard deviation of the elastic deformation rate (τe).

In addition, when such a polymer material is added in a large amount, the curing reaction is not completely performed, thereby decreasing the crosslinkage density, and therefore the outermost layer cannot have an elastic deformation rate (τe) of not less than 35%.

Therefore, it is preferable not to use a radically polymerizable di- or more-functional compound or a binder resin for the outermost layer coating liquid.

With respect to the solvent used for diluting the outermost layer coating liquid, when a solvent which easily dissolves the lower layer is included in the coating liquid in a large amount, the binder resin and the low molecular weight charge transport material included in the lower layer migrate into the coated outermost layer, thereby interrupting the curing reaction or unevenly performing the curing reaction similarly to the above-mentioned case in which a non-curable material is included in a large amount in the coating liquid.

In contrast, when a solvent which does not dissolve the lower layer is used for the outermost coating liquid, the adhesiveness of the resultant outermost layer to the lower layer deteriorates, and a crater-shaped eye hole is formed in the outermost layer due to volume shrinkage of the outermost layer, resulting in partial exposure of the lower layer, which has a lower elastic deformation rate.

In order to prevent occurrence of these problems, the following measures can be taken.

(1) A mixture of a solvent which dissolves the lower layer and a solvent which does not dissolve the lower layer is used to control the lower layer dissolving ability of the coating liquid;

(2) The amount of the solvent included in the coated outermost layer coating liquid is decreased by properly adjusting the composition of the coating liquid and/or using a proper coating method;

(3) A material having a proper resistance to solvents such as charge transport polymers is used for the lower layer; and (4) A layer having relatively low solubility or a layer having good adhesiveness is formed between the lower layer and the outermost layer.

It is necessary for the crosslinked outermost layer to include a bulky charge transport structure to maintain good electric properties while enhancing the crosslinkage density to enhance the strength of the layer.

If excessively high energy is applied from outside to rapidly cure the coated outermost layer, the curing reaction unevenly proceeds, thereby increasing the standard deviation of the elastic deformation rate (τe). Therefore, in order to evenly perform the curing reaction, external energy such as heat energy and light energy is preferably used because the curing speed can be controlled by controlling the heating condition or light intensity, and the added amount of the polymerization initiator.

Next, a specific method for forming a crosslinked outermost layer having an elastic deformation rate (τe) of not less than 35% with a standard deviation of not greater than 2% will be described. When an acrylate monomer having three acryloyloxy groups and a triarylamine compound having one acryloyloxy group are used for the outermost layer coating liquid, a polymerization initiator is added in an amount of from 3 to 10% by weight based on the total weight of the acrylate compounds, and a solvent is further added to prepare the outermost layer coating liquid. In this regard, when the lower layer (e.g., charge transport layer) includes a triarylamine type donor serving as a charge transport material and a polycarbonate resin serving as a binder resin, and the outermost layer is formed by spray coating, the solvent used for the outermost layer coating liquid is preferably tetrahydrofuran, 2-butanone or ethyl acetate. The added amount of the solvent is preferably from 200 to 800 parts by weight based on 100 parts by weight (total weight) of the acrylate compounds.

The thus prepared outermost layer coating liquid is applied, for example, by a spray coating method on a charge transport layer of a photoconductor which has a structure such that an undercoat layer is formed on a substrate (such as an aluminum cylinder), a charge generation layer is formed on the undercoat layer, and the charge transport layer is formed on the charge generation layer. After the coated outermost layer is dried for a short time (1 to 10 minutes) at a low temperature (25 to 80° C.), the coated outermost layer is irradiated with UV light or heated to be cured.

When UV light is used, a metal halide lamp is preferably used, and the irradiance is preferably from 50 to 1,000 $mW/cm^2$. When the irradiance is 500 $mW/cm^2$, the outermost layer is irradiated with UV light from multiple directions for about 20 seconds. In this regard, the temperature of the substrate of the photoconductor is preferably controlled so as to be not higher than 50° C.

When thermal curing is performed, the heating temperature is preferably from 100 to 170° C. When an oven using a fan is used as the heating device and the heating temperature is 150° C., the heating time is from 20 minutes to 3 hours.

After the curing treatment, the photoconductor is further heated for 10 to 30 minutes at a temperature of from 100 to 150° C. to decrease the amount of residual solvent included in the photoconductor.

In order to enhance stability of the photoconductor to withstand environmental conditions, particularly, to prevent deterioration of photosensitivity and increase of residual potential, each of the layers such as the protective layer, and the photosensitive layer (such as the charge generation layer, the charge transport layer, and the single-layered photosensitive layer) can include an antioxidant, a plasticizer, a lubricant, an ultraviolet absorbent, and a leveling agent.

Specific examples of the antioxidant include phenolic compounds, paraphenylenediamine compounds, hydroquinone compounds, organic sulfur compounds, and organic phosphorous compounds, but are not limited thereto.

Specific examples of the plasticizer include phosphoric acid ester-based plasticizers, phthalic acid ester-based plasticizers, aromatic carboxylic acid ester-based plasticizers, aliphatic dibasic acid ester-based plasticizers, fatty acid ester-based plasticizers, oxyacid ester-based plasticizers, epoxy plasticizers, dihydric alcohol ester-based plasticizers, chlorine-containing plasticizers, polyester-based plasticizers, sulfonic acid-based plasticizers, and citric acid-based plasticizers, but are not limited thereto.

Specific examples of the lubricant include hydrocarbon compounds, fatty acid based compounds, fatty acid amide compounds, ester compounds, alcohol compounds, metal soaps, natural waxes, silicone compounds, and fluorine-containing compounds, but are not limited thereto.

Specific examples of the ultraviolet absorbent include benzophenone compounds, salicylate compounds, benzotriazole compounds, cyanoacrylate compounds, quenchers (such as metal complexes), and hindered amines (HALS (hindered amine light stabilizer)), but are not limited thereto.

Next, the image forming apparatus and the image forming method of this disclosure will be described.

The image forming apparatus of this disclosure includes the above-mentioned photoconductor of this disclosure, a charger to charge a surface of the photoconductor, an irradiator to irradiate the charged surface of the photoconductor with light to form an electrostatic latent image thereon, a developing device to develop the electrostatic latent image with a developer including a toner to form a toner image on the surface of the photoconductor, and a transferring device to transfer the toner image to a recording medium. The image forming apparatus optionally includes other devices such as a fixing device to fix the toner image to the recording medium, a cleaner to clean the surface of the photoconductor after the toner image is transferred to the recording medium, a discharger to remove residual charges from the surface of the photoconductor after the toner image is transferred to the recording medium, a recycling device to feed the toner collected by the cleaner to the developing device, and a controller to control the above-mentioned devices of the image forming apparatus.

Initially, a first example of the image forming apparatus will be described by reference to FIG. 7.

Figure 7:
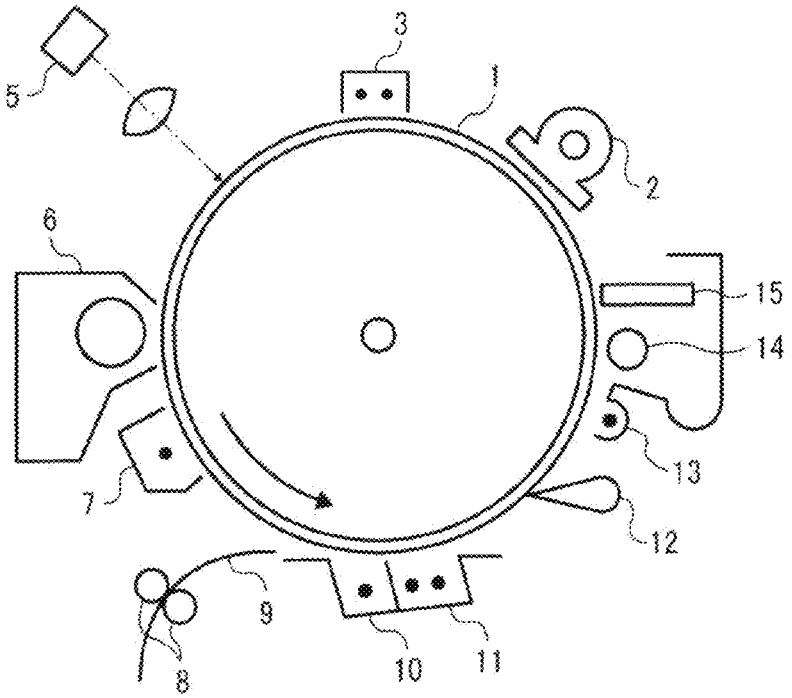
FIG. 7 is a schematic view, which illustrates an example of an image forming apparatus according to an embodiment and which is used for describing an image forming method according to an embodiment.

FIG. 7 is a schematic view illustrating the first example of the image forming apparatus of this disclosure, and is used for describing the image forming apparatus and the image forming method of this disclosure.

Referring to FIG. 7, the image forming apparatus include a photoconductor 1, which is the above-mentioned photoconductor of this disclosure. The photoconductor 1 illustrated in FIG. 7 has a drum shape, but the photoconductor can have another shape such as sheet shape or endless-belt shape.

In the image forming apparatus illustrated in FIG. 7, the drum-shaped photoconductor 1 is rotated counterclockwise by a driving device (not shown) so as to be subjected to the below-mentioned electrophotographic processes using the above-mentioned devices. Hereinafter, the electrophotographic processes and the devices used therefor will be described in order.

(Charger and Charging Process)

Initially, the surface of the photoconductor 1 is evenly charged by a charger 3. In this regard, a proper charger is selected from known chargers in consideration of the properties of the photoconductor and the toner used for the developer. Specifically, any charger capable of charging the surface of the photoconductor 1 so that the photoconductor has a charge with the predetermined polarity (i.e., positive or negative polarity) can be used as the charger 3. Specific examples of the charger include corotrons, scorotrons, solid state dischargers, charging rollers, etc.

(Irradiator and Irradiating Process)

Next, the evenly charged surface of the photoconductor 1 is irradiated with light emitted by an irradiator 5, thereby forming an electrostatic latent image on the surface of the photoconductor 1. The irradiator 5 has a light source to irradiate the charged photoconductor 1 with light. Suitable light sources for use in the irradiator 5 include fluorescent lamps, tungsten lamps, halogen lamps, mercury lamps, sodium lamps, light emitting diodes (LEDs), laser diodes (LDs), and light sources using electroluminescence (EL). Among these light sources, LEDs and LDs are preferable. In addition, in order to obtain light having a desired wave length region, a filter such as sharp-cut filters, band pass filters, near-infrared cutting filters, dichroic filters, interference filters, and color temperature converting filters can be arranged between the irradiator 5 and the photoconductor 1.

(Developing Device and Developing Process)

Next, the developing device 6 develops the electrostatic latent image on the photoconductor 1 with a developer including a toner to form a toner image (i.e., a visible image) on the photoconductor 1. A proper developing device is selected from known developing devices depending on the toner used. Specific examples of the developing device include one-component developing devices using a toner as a one-component developer, and two component developing devices using a two-component developer including a carrier and a toner. The one-component developing devices are classified into developing devices using a magnetic toner and developing devices using a non-magnetic toner, and the two-component developing devices are also classified into developing devices using a magnetic toner and developing devices using a non-magnetic toner.

(Transferring Device and Transferring Process)

The toner image on the photoconductor 1 is fed to a transfer charger 10, which serves as a transferring device, as the photoconductor 1 rotates in a direction indicated by an arrow. The chargers mentioned above for use as the charger 3 can also be used for the transfer charger 10. Among these chargers, a combination of the transfer charger 10 and a separation charger 11, which is illustrated in FIG. 7, is preferably used because of being effective. In order to enhance the transfer efficiency, a pre-transfer charger 7 is preferably arranged on an upstream side from the transfer charger 10 relative to the rotation direction of the photoconductor 1 to preliminarily charge the toner image on the photoconductor 1. The chargers mentioned above for use as the charger 3 can also be used for the pre-transfer charger 7.

Meanwhile, a transfer paper 9 serving as a recording medium is fed by a pair of registration rollers 8 to a transfer position, at which the transfer charger 10 is opposed to the photoconductor 1, so that the toner image on the photoconductor 1 is transferred onto a proper position of the transfer paper 9 at the transfer position by the transfer charger 10.

The transfer paper 9 bearing the toner image thereon is fed to a separation claw 12 as the photoconductor 1 rotates, and is separated by the separation pick 12 from the surface of the photoconductor 1. The transfer paper 9 is then fed to a fixing device (such as a fixing device 65 illustrated in FIG. 9) so that the toner image is fixed to the transfer paper 9, resulting in formation of a print. The print is then discharged from the main body of the image forming apparatus.

(Cleaner and Cleaning Process)

After the transfer paper 9, to which the toner image is transferred by the transfer charger 10, is separated from the surface of the photoconductor 1 by the separation claw 12, foreign materials such as residual toner particles, which are not transferred to the transfer paper 9, and paper dust remain on the surface of the photoconductor 1. Therefore, such foreign materials are removed from the surface of the photoconductor 1 by a combination of a fur brush 14 and a cleaning blade 15, which serve as a cleaner. In this regard, any known cleaners such as a magnetic fur brush, a fur brush by itself, and a cleaning blade by itself can be used as the cleaner as well as the combination of the fur brush 14 and the cleaning blade 15. In order to enhance the cleaning efficiency, a pre-cleaning charger 13 to preliminarily charge the foreign materials on the photoconductor 1 is preferably arranged on an upstream side from the cleaner relative to the rotation direction of the photoconductor 1. The chargers mentioned above for use as the charger 3 can also be used for the pre-cleaning charger 13.

(Discharger and Discharging Process)

After the surface of the photoconductor 1 is cleaned by the cleaner, the surface is irradiated with a discharge lamp 2 serving as a discharger to remove residual charges from the surface of the photoconductor 1.

Thus, a series of electrophotographic image forming processes is completed. By repeating the series of electrophotographic image forming processes, plural prints can be formed.

Any known dischargers such as chargers and discharging lamps can be used for the discharger. When a discharging lamp is used as the discharger, the light sources mentioned above for use in the irradiator 5 can be used for the discharging lamp.

In the series of electrophotographic image forming processes mentioned above, when the photoconductor 1, which is previously charged positively (or negatively), is exposed to light, an electrostatic latent image having a positive (or negative) charge is formed on the photoconductor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. The polarity of the charge to be formed on the photoconductor 1 and the polarity of the charge of the toner are not particularly limited, and are arbitrarily chosen.

The light sources for use in the irradiator 5 can also be used for a transferring process using irradiation, a discharging process using irradiation, a cleaning process using irradiation, and an optionally performed pre-irradiating process, which is an irradiating process performed before the irradiating process mentioned above.

Next, a second example of the image forming apparatus of this disclosure will be described by reference to FIG. 8.

Figure 8:
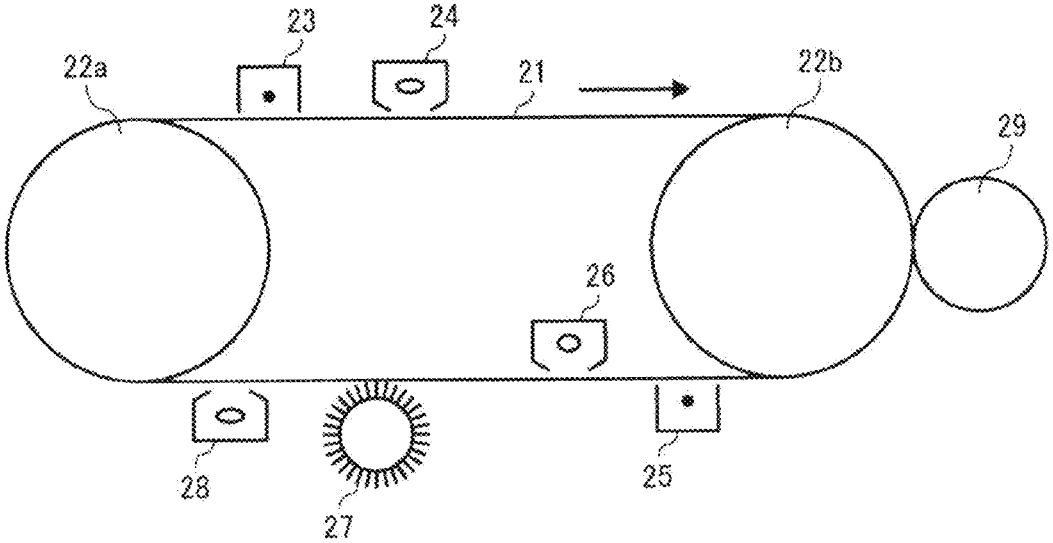
FIG. 8 is a schematic view illustrating another example of the image forming apparatus.

FIG. 8 is a schematic view illustrating a second example of the image forming apparatus of this disclosure.

The image forming apparatus illustrated in FIG. 8 includes an endless belt-form photoconductor 21, which is the above-mentioned photoconductor of this disclosure and which is rotated in a direction indicated by an arrow by driving rollers 22*a* and 22*b*, a charger 23 to charge the surface of the photoconductor 21, an irradiator 24 to irradiate the charged surface of the photoconductor 21 with light to form an electrostatic latent image thereon, a developing device 29 to develop the electrostatic latent image with a developer including a toner to form a toner image on the surface of the photoconductor 21, a transfer charger 25 to transfer the toner image onto a recording medium (not shown in FIG. 8), a pre-cleaning irradiator 26 to irradiate the photoconductor before a cleaning process, a cleaning brush 27 to clean the surface of the photoconductor 21, and a discharging lamp 28 to remove residual charges from the surface of the photoconductor 21. These processes are repeatedly performed in the image forming apparatus.

In the image forming apparatus illustrated in FIG. 8, the pre-cleaning irradiation is performed from the backside of the photoconductor 21. In this case, the electroconductive substrate 31 and the intermediate layer 32 preferably have good light permeability.

The structure of the image forming apparatus is not limited to the structure illustrated in FIG. 8. For example, the pre-cleaning irradiation can be performed from the front side of the photoconductor 21. In addition, the irradiation (optical image irradiation) to form an electrostatic latent image and the irradiation (discharge irradiation) to remove residual charges from the surface of the photoconductor can be performed from the backside of the photoconductor 21. In addition, although the optical image irradiation using the irradiator 24, the pre-cleaning irradiation using the pre-cleaning irradiator 26, and the discharge irradiation using the discharging lamp 28 are illustrated in FIG. 8, other irradiation processes such as pre-transfer irradiation and pre-irradiation performed before the optical image irradiation can also be performed on the photoconductor 21.

Next, a third example of the image forming apparatus of this disclosure will be described by reference to FIG. 9.

Figure 9:
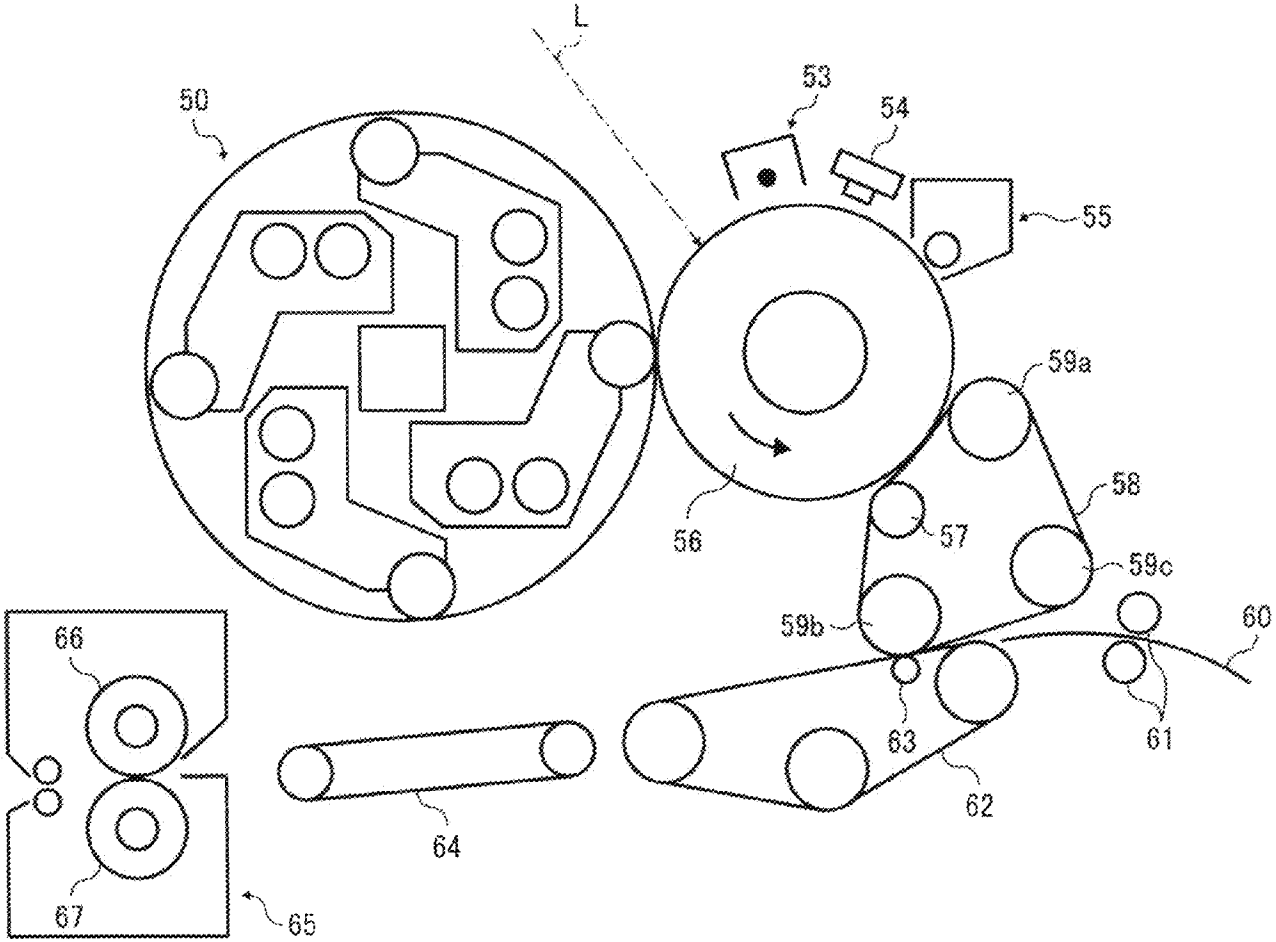
FIG. 9 is a schematic view illustrating another example of the image forming apparatus.

FIG. 9 is a schematic view illustrating a full color printer, which is an example of the image forming apparatus of this disclosure.

Referring to FIG. 9, the printer includes a drum-shaped photoconductor 56, which is rotated counterclockwise, a charger 53 (such as corotrons and scorotrons) to charge a surface of the photoconductor 56, a laser optical device serving as an optical image irradiator to irradiate the charge surface of the photoconductor 56 with laser light L to form an electrostatic latent image on the photoconductor 56. In this regard, the optical image irradiation is performed based on image information of an original full color image, which is separated into yellow image information, magenta image information, cyan image information and black image information, and therefore electrostatic latent images corresponding to yellow, magenta, cyan and black images are formed on the photoconductor 56. In this printer, a laser diode is used for the laser optical device.

A revolver-type developing unit 50 is provided at the left side of the photoconductor 56. The developing unit 50 includes a yellow developing device, a magenta developing device, a cyan developing device, and a black developing device, which are arranged in a rotatable drum-shaped chassis. Since the chassis can rotate, the yellow, magenta, cyan and black developing devices are moved so that one of the developing devices is positioned so as to be opposed to the photoconductor 56. The yellow, magenta, cyan and black developing devices develop the corresponding electrostatic latent images on the photoconductor 56 with yellow, magenta, cyan and black toners, respectively, thereby forming yellow, magenta, cyan and black toner images on the photoconductor 56.

An intermediate transfer unit is provided on a downstream side from the developing unit 50 relative to the rotation direction of the photoconductor 56. The intermediate transfer unit includes an endless belt-form intermediate transfer belt 58, which is rotated clockwise while tightly stretched by a tension roller 59*a*, an intermediate transfer bias roller 57 serving as a primary transferring device, a secondary transfer backup roller 59*b*, and a belt driving roller 59*c* to drive the intermediate transfer belt 58.

The yellow, magenta, cyan and black toner images formed on the photoconductor 56 are fed to a primary transfer nip, at which the surface of the photoconductor 56 is contacted with the surface of the intermediate transfer belt 58, as the photoconductor 56 rotates. The yellow, magenta, cyan and black toner images are transferred onto the intermediate transfer belt 58 by the bias applied by the intermediate transfer bias roller 57 in such a manner that the toner images are overlaid, resulting formation of a combined color toner image of the yellow, magenta, cyan and black toner images.

After the toner images on the photoconductor 56 are transferred onto the intermediate transfer belt 58, the surface of the photoconductor 56 is cleaned by a drum cleaner 55 to remove residual toners from the surface of the photoconductor. The drum cleaner 55 includes a cleaning roller to which a cleaning bias is applied. However, the drum cleaner 55 is not limited thereto, and cleaning brushes such as fur brushes and magnetic fur brushes, and cleaning blades can also be used therefor.

After the cleaning process, the surface of the photoconductor 56 is discharged by a discharging lamp 54 serving as a discharger. In this regard, fluorescent lamps, tungsten lamps, halogen lamps, mercury lamps, sodium lamps, light emitting diodes (LEDs), laser diodes (LDs), and light sources using electroluminescence (EL) can be used for the discharging lamp 54. In order to obtain light having a desired wave length region, a filter such as sharp-cut filters, band pass filters, near-infrared cutting filters, dichroic filters, interference filters, and color temperature converting filters can be used.

Meanwhile, a transfer paper 60 serving as a recording medium, which has been fed from a sheet feeding cassette (not shown) and which is pinched by a pair of registration rollers 61, is timely fed by the pair of registration rollers 61 to the secondary transfer nip at which the intermediate transfer belt 58 is contacted with a transfer belt 62 so that the combined color toner image on the intermediate transfer belt 58 is secondarily transferred to a proper position of the transfer paper 60. Specifically, the combined color toner image is transferred at the secondary transfer nip to the transfer paper 60 by the secondary transfer bias applied by a secondary transfer bias roller 63, thereby forming a full color image on the transfer paper 60. The transfer paper 60 bearing the full color toner image thereon is fed to a feeding belt 64 by a transfer belt 62. The feeding belt 64 feeds the transfer paper 60 to a fixing device 65. The fixing device 65 feeds the transfer paper 60 through a nip formed by a heat roller 66 and a backup roller 67 so that the full color image is fixed to the transfer paper 60 by the heat applied by the heat roller 66 and the pressure applied by the heat roller 66 and the backup roller 67. Thus, a full color print is formed.

Although not illustrated in FIG. 9, a bias is applied to each of the transfer belt 62 and the feeding belt 64 so that the transfer belt and the feeding belt attract the transfer paper 60. In addition, a paper discharger is provided to remove charges from the transfer paper 60, and belt dischargers are provided to remove charges from the belts such as the intermediate transfer belt 58, the transfer belt 62 and the feeding belt 64. Further, the intermediate transfer unit includes a belt cleaner similar to the drum cleaner 55 to remove residual (non-transferred) toner particles from the intermediate transfer belt 58.

Thus, the image forming apparatus of this disclosure can have a configuration such that a toner image formed on the above-mentioned photoconductor is primarily transferred to an intermediate transfer medium by a transferring device (primary transferring device), and the toner image is secondarily transferred to a recording medium by an intermediate transferring device (secondary transferring device).

In this regard, when the secondarily transferred toner image is a color toner image including plural color toner images, color toner images, which are formed on a photoconductor, are primarily transferred one by one onto the intermediate transfer medium by the primary transferring device to form a combined color toner image on the intermediate transfer medium, and the combined color toner image is secondarily transferred at once onto the recording medium by the secondary transferring device.

Next, a fourth example of the image forming apparatus will be described by reference to FIG. 10.

Figure 10:
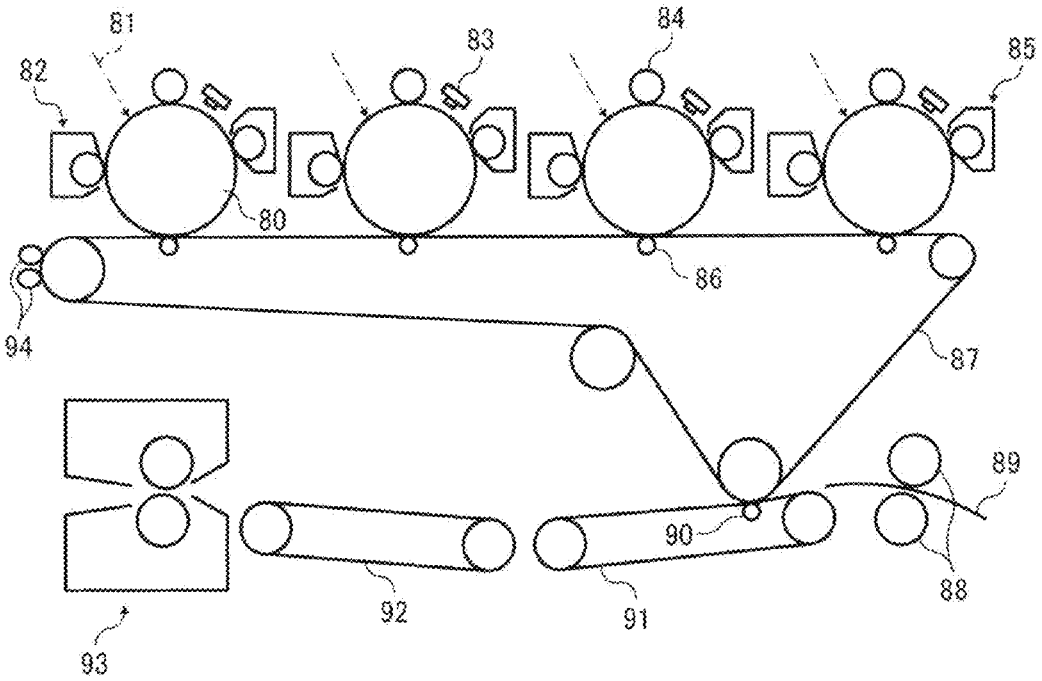
FIG. 10 is a schematic view illustrating another example of the image forming apparatus.

FIG. 10 is a schematic view illustrating a tandem image forming apparatus, which is an example of the image forming apparatus of this disclosure.

Referring to FIG. 10, the image forming apparatus includes an intermediate transfer belt 87, and four photoconductors 80, which produce yellow (Y), magenta (M), cyan (C), and black (K) toner images, respectively, unlike the printer illustrated in FIG. 7 in which color toner images are formed on one photoconductor. In addition, the image forming apparatus includes four chargers 84, four developing devices 82, four drum cleaners 85, four discharging lamps (dischargers) 83, and four bias rollers (secondary transferring devices) 86 for forming Y, M, C and K toner images. Although the printer illustrated in FIG. 9 uses a corona charger for the charger 53 to evenly charge the photoconductor 56, the image forming apparatus illustrated in FIG. 10 uses a charging roller 84 for the charger 84.

The image forming apparatus also includes a fur brush 94 to clean the surface of the intermediate transfer belt 87. In addition, the image forming apparatus includes a pair of registration rollers 88, a transfer bias roller 90, a transfer belt 91, a feeding belt 92, and a fixing device 93. Since these devices are similar to the corresponding devices of the third example of the image forming apparatus illustrated in FIG. 9, description of the devices is omitted here. In addition, the image forming apparatus uses a transfer paper 89 as a recording medium.

The tandem image forming apparatus can produce color images at a speed much higher than that of the image forming apparatus mentioned above using a revolver-type developing unit because of performing each of formation of electrostatic latent images corresponding to color images (i.e., irradiation processes) and development of the electrostatic latent images (i.e., development processes) in parallel.

Next, the process cartridge of this disclosure will be described.

Although the above-mentioned photoconductor and devices of the image forming apparatus can be fixedly set in an image forming apparatus such as copiers, printers and facsimiles, the photoconductor and devices can also be set to an image forming apparatus as a process cartridge. The process cartridge of this disclosure is a device (part), which includes the photoconductor of this disclosure, and at least one of a charger to charge a surface of the photoconductor, an irradiator to irradiate the charged surface of the photoconductor to form an electrostatic latent image thereon, a developing device to develop the electrostatic latent image with a developer including a toner to form a toner image on the photoconductor, a transferring device to transfer the toner image onto a recording medium (or intermediate transfer medium), a cleaner to clean the surface of the photoconductor, and a discharger to remove residual charges on the photoconductor.

Figure 11:
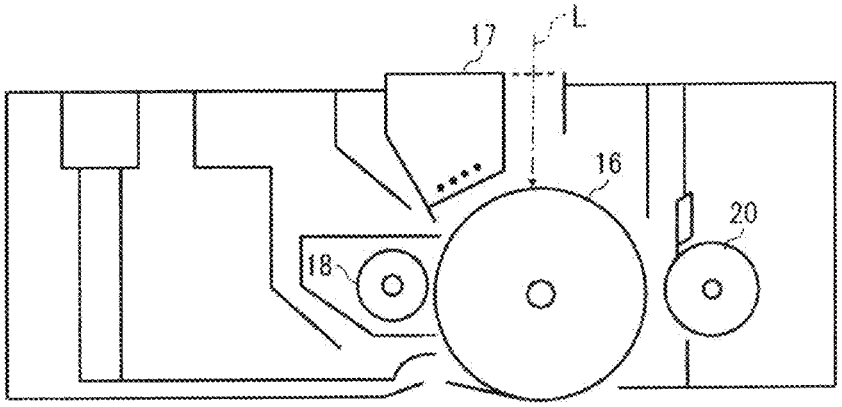
FIG. 11 is a schematic view illustrating an example of a process cartridge according to an embodiment.

There are a number of process cartridges having different shapes and configurations, and one example is illustrated in FIG. 11.

FIG. 11 is a schematic view illustrating an example of the process cartridge of this disclosure.

Referring to FIG. 11, the process cartridge includes a photoconductor 16, which is the photoconductor of this disclosure mentioned above, a charger 17 to charge the surface of the photoconductor 17, a developing roller 20 serving as a developing device to develop the electrostatic latent image with a developer including a toner to form a toner image on the surface of the photoconductor 17, and a cleaning brush 18 serving as a cleaner to clean the surface of the photoconductor 17. In FIG. 11, character L denotes a light beam emitted by an irradiator (not illustrated in FIG. 11) to form an electrostatic latent image on the surface of the photoconductor 16.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

1. Preparation of Intermediate Layer Coating Liquid

Initially, a surface-treated zinc oxide was prepared. Specifically, the following components were mixed for 2 hours while agitated.

| | |
|---|---|
| Zinc oxide prepared by the wet method mentioned above (Contents of Na and Ca determined by ICP-MS were 54 ppm and 47 ppm, respectively, and content of S determined by ICP-AES was 250 ppm) | 1,000 parts |
| Silane-coupling agent including amino group (surface treatment agent) (KBE 903 (3-aminopropyltriethoxysilane) from Shin-Etsu Chemical Co., Ltd.) | 10 parts |
| Toluene (solvent) | 5,000 parts |

The mixture was subjected to reduced-pressure distillation to distil away toluene. Thereafter, the zinc oxide was heated (baked) for 4 hours at 130 to prepare a surface-treated zinc oxide.

Next, the following components were mixed.

| | |
|---|---|
| Surface-treated zinc oxide prepared above | 300 parts |
| Blocked isocyanate (binder resin) (SUMIDUR BL3175 from Sumika Bayer Urethane Co., Ltd., solid content of 75% by weight) | 60 parts |
| 2-Butanone solution of butyral resin (Butyral resin: S-LEC BM-S from Sekisui Chemical Co., Ltd., solid content of 20% by weight) | 225 parts |
| 2-Butanone (solvent) | 105 parts |

The mixture was subjected to milling for 10 hours using a vibration mill and glass beads with a particle diameter of 0.4 mm. Thus, the intermediate layer coating liquid was prepared.

Randomly selected 100 particles of the above-prepared surface treated zinc oxide were observed by a transmission electron microscope (TEM) to determine the areas of the projected images of the particles. The volume average primary particle diameter of the surface treated zinc oxide was determined from the diameters of circles having the same areas as the projected images of the surface treated zinc oxide. As a result, the volume average primary particle diameter of the surface treated zinc oxide was 95 nm.

2. Preparation of Charge Generation Layer Coating Liquid

The following components were mixed.

| | |
|---|---|
| Y-form titanyl phthalocyanine (charge generation material) (Powder X-ray diffraction spectrum of the Y-form titanyl phthalocyanine is illustrated in FIG. 10) | 8 parts |

-continued

| | |
|---|---|
| Polyvinyl butyral (binder resin) (Polyvinyl butyral: S-LEC BX-1 from Sekisui Chemical Co., Ltd.) | 5 parts |
| 2-Butanone (solvent) | 400 parts |

The mixture was subjected to milling for 8 hours using a bead mill and glass beads with a particle diameter of 1 mm. Thus, a charge generation layer coating liquid was prepared.

Figure 12:
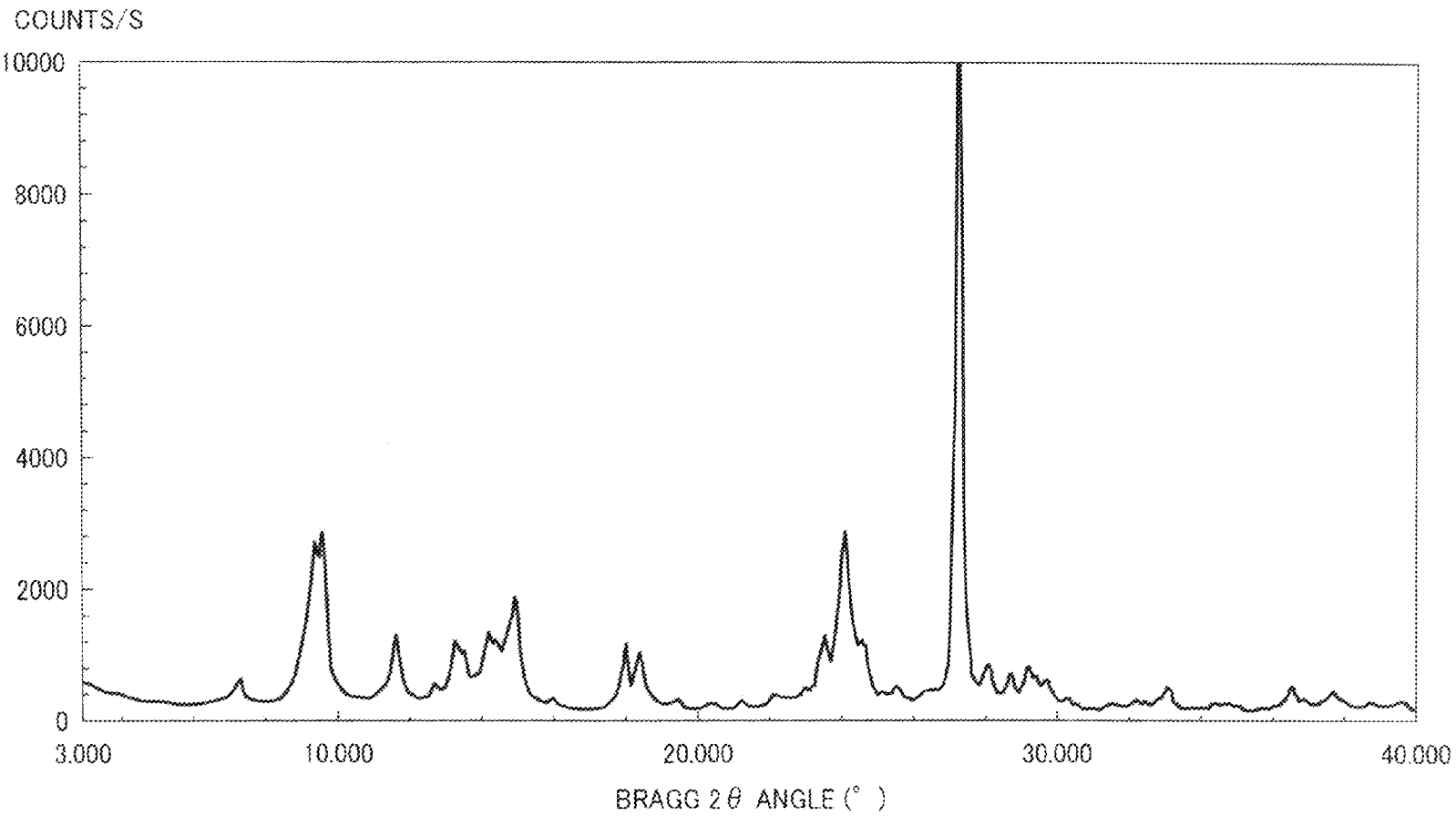
FIG. 12 is an X-ray diffraction spectrum of a Y-form titanyl phthalocyanine used as the charge generation material of photoconductors of Examples 1-24 and Comparative Examples 1-8.

FIG. 12 illustrates the powder X-ray diffraction spectrum of the Y-form titanyl phthalocyanine used as the charge generation material.

3. Preparation of Charge Transport Layer Coating Liquid

The following components were mixed until the charge transport material and the binder resin were dissolved in the solvent to prepare a charge transport layer coating liquid.

| | |
|---|---|
| Compound having the following formula (1) (charge transport material) | 7 parts |

Formula (1)

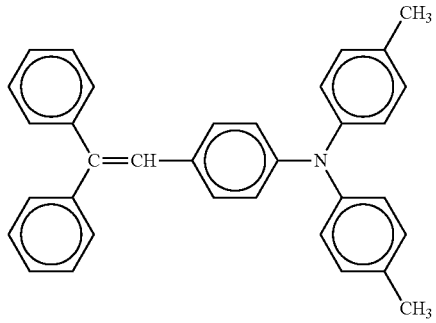

| | |
|---|---|
| Polycarbonate (binder resin) (TS-2050 from Teijin Chemical Ltd.) | 10 parts |
| Silicone oil (leveling agent) (KF-50 from Shin-Etsu Chemical Co., Ltd.) | 0.0005 parts |
| Tetrahydrofuran (solvent) | 100 parts |

4. Preparation of Photoconductor

The above-prepared intermediate layer coating liquid was applied on the surface of an aluminum cylinder by a dip coating method, followed by drying for 30 minutes at 170° C. Thus, an intermediate layer with a film thickness of 22 μm was formed on the surface of the aluminum cylinder.

Next, the above-prepared charge generation layer coating liquid was applied on the surface of the intermediate layer of the aluminum cylinder by a dip coating method, followed by drying for 30 minutes at 90° C. Thus, a charge generation layer with a film thickness of 0.2 μm was formed on the intermediate layer of the aluminum cylinder.

Further, the above-prepared charge transport layer coating liquid was applied on the surface of the charge generation layer of the aluminum cylinder by a dip coating method, followed by drying for 30 minutes at 150° C. Thus, a charge transport layer with a film thickness of 29 μm was formed on the charge generation layer of the aluminum cylinder, resulting in preparation of a photoconductor of Example 1.

The thus prepared photoconductor was evaluated with respect to the following properties.

1. Elastic Deformation Rate and Potential after Elastic Fatigue

The photoconductor (sample) was cut so as to have a proper size, and the cut sample was set in a dynamic micro surface hardness tester DUH-201 from Shimadzu Corp. By using a pressing member having a triangular pyramid shape with an angle of 115°, the sample was subjected to an elastic deformation rate measurement including a cycle of operations of loading, resting and unloading to obtain such a load-deformation curve as illustrated in FIG. 2.

In this regard, the load was set so that the maximum deformation amount of the sample becomes 1/10 of the thickness of the outermost layer of the sample. In addition, each of the loading and unloading speeds was set to 0.0145 gf/sec ($1.42\times10^{-4}$ N/sec), and the rest time was set to 5 seconds.

The elastic deformation rate (τe) of the sample was determined from the following equation:

$$\text{Elastic deformation rate}(\tau e)=[(MD-PD)/MD]\times100$$

wherein MD represents the maximum deformation amount of the sample, and PD represents the plastic deformation amount of the sample, as illustrated in FIG. 2.

In this regard, the elastic deformation rate (τe) of each of randomly selected 10 points of the sample was measured and averaged to obtain the elastic deformation rate (τe) of the sample, and the standard deviation of the elastic deformation rate (τe) was calculated from the 10 data of the elastic deformation rate (τe).

2. Electric Properties (Initial Potential of Photoconductor and Potential Thereof after Repeated Use)

The photoconductor was charged by a scorotron charger under environmental conditions of 23° C. and 50% RH while adjusting the discharge current so that the photoconductor has a potential V0 (potential of a non-irradiated portion) of −700±10V. The charged photoconductor was irradiated with laser light with a wavelength of 780 nm and irradiation energy of 1.0 μJ/cm$^2$ using a laser diode to determine the potential VL of the irradiated portion of the photoconductor. After the photoconductor was repeatedly subjected to a running test in which 50,000 cycles of the charging and irradiating processes, the potentials V0' and VL' of the photoconductor were also measured. In this regard, adjustment of the discharge current in the charging process was performed only at the start of the running test.

Each of the potentials V0 and V0' is preferably −700±50V. When the potential is out of the range, the image density visibly changes (increases or decreases).

Each of the potentials VL and VL' is preferably lower than about 150V. When the potential is out of the range, the image density decreases. In addition, when the potential VL' is higher than the initial potential VL by 50V or more (i.e., ΔVL is 50V or more), images with noises are formed.

3. Abrasion Loss (Decrease in Film Thickness of Photoconductor) and Image Quality The photoconductor was set to a color laser printer IPSIO SP C241 from Ricoh Co., Ltd, and 50,000 copies of a test pattern image, which includes a black solid image and a white image portion (i.e., background) and which has an image area proportion of 5%, were produced under an environmental condition of 23° C. and 55% RH. The 50,000$^{th}$ image was visually observed to determine whether the image has background fog (black spots) and whether the image has good image density. In addition, the abrasion loss of the photoconductor was measured.

The abrasion loss was determined by checking the film thickness of the layers of the photoconductor before and after the 50,000-copy running test using an eddy current type film thickness meter, and calculating the difference (i.e., abrasion loss) between the film thickness before the running test and the film thickness after the running test.

The background fog property of the photoconductor was graded as follows.

○: The background of the image has no clear black spot.

X: The background of the image has a clear black spot.

The image density property of the photoconductor was graded as follows.

○: The black solid image portion of the image has good image density. Specifically, the difference (ΔID) between the image density of the first image, which is measured by a MACBETH reflection densitometer (manufactured by Gretag Macbeth), and the image density of the 50,000$^{th}$ image is less than 0.05.

X: The image density of the black solid image portion of the image is lower than that of the first image, and the image density difference (ΔID) is not less than 0.05.

The evaluation results are shown in Tables 1-1 and 1-2 below.

Example 2

The procedure for preparation and evaluation of the photoconductor of Example 1 was repeated except that the Na, Ca and S contents of the surface treated zinc oxide were changed to 94 ppm, 46 ppm and 160 ppm, respectively, and the volume average primary particle diameter of the surface treated zinc oxide was changed to 86 nm. The evaluation results of the thus prepared photoconductor of Example 2 are also shown in Tables 1-1 and 1-2.

Example 3

The procedure for preparation and evaluation of the photoconductor of Example 1 was repeated except that the Na, Ca and S contents of the surface treated zinc oxide were changed to 87 ppm, 140 ppm and 86 ppm, respectively, and the volume average primary particle diameter of the surface treated zinc oxide was changed to 105 nm. The evaluation results of the thus prepared photoconductor of Example 3 are also shown in Tables 1-1 and 1-2.

Example 4

The procedure for preparation and evaluation of the photoconductor of Example 1 was repeated except that the Na, Ca and S contents of the surface treated zinc oxide were changed to 15 ppm, 55 ppm and 216 ppm, respectively, and the volume average primary particle diameter of the surface treated zinc oxide was changed to 80 nm. The evaluation results of the thus prepared photoconductor of Example 4 are also shown in Tables 1-1 and 1-2.

Example 5

The procedure for preparation and evaluation of the photoconductor of Example 1 was repeated except that the Na, Ca and S contents of the surface treated zinc oxide were changed to 90 ppm, 14 ppm and 130 ppm, respectively, and the volume average primary particle diameter of the surface treated zinc oxide was changed to 65 nm. The evaluation results of the thus prepared photoconductor of Example 5 are also shown in Tables 1-1 and 1-2.

Example 6

The procedure for preparation and evaluation of the photoconductor of Example 1 was repeated except that the Na, Ca and S contents of the surface treated zinc oxide were changed to 62 ppm, 51 ppm and 54 ppm, respectively, and the volume average primary particle diameter of the surface treated zinc oxide was changed to 80 nm. The evaluation results of the thus prepared photoconductor of Example 6 are also shown in Tables 1-1 and 1-2.

Example 7

The procedure for preparation and evaluation of the photoconductor of Example 1 was repeated except that the Na, Ca and S contents of the surface treated zinc oxide were changed to 189 ppm, 120 ppm and 290 ppm, respectively, and the volume average primary particle diameter of the surface treated zinc oxide was changed to 69 nm. The evaluation results of the thus prepared photoconductor of Example 7 are also shown in Tables 1-1 and 1-2.

Example 8

The procedure for preparation and evaluation of the photoconductor of Example 1 was repeated except that the Na, Ca and S contents of the surface treated zinc oxide were changed to 53 ppm, 194 ppm and 168 ppm, respectively, and the volume average primary particle diameter of the surface treated zinc oxide was changed to 77 nm. The evaluation results of the thus prepared photoconductor of Example 8 are also shown in Tables 1-1 and 1-2.

Example 9

The procedure for preparation and evaluation of the photoconductor of Example 1 was repeated except that the Na, Ca and S contents of the surface treated zinc oxide were changed to 98 ppm, 110 ppm and 489 ppm, respectively, and the volume average primary particle diameter of the surface treated zinc oxide was changed to 69 nm. The evaluation results of the thus prepared photoconductor of Example 9 are also shown in Tables 1-1 and 1-2.

Example 10

The procedure for preparation and evaluation of the photoconductor of Example 1 was repeated except that the surface treated zinc oxide was replaced with a zinc oxide, which includes Na, Ca and S in amounts of 65 ppm, 49 ppm and 184 ppm, respectively, while having a volume average primary particle diameter of 98 nm and which is not subjected to the surface treatment using the silane coupling agent. The evaluation results of the thus prepared photoconductor of Example 10 are also shown in Tables 1-1 and 1-2.

Example 11

The procedure for preparation and evaluation of the photoconductor of Example 1 was repeated except that the silane coupling agent KBE 903 was replaced with another silane coupling agent including no amino group, KBE 502 (3-methacryloxypropylmethyldiethoxysilane) from Shin-Etsu Chemical Co., Ltd., the Na, Ca and S contents of the surface treated zinc oxide were changed to 68 ppm, 46 ppm and 290 ppm, respectively, and the volume average primary particle diameter of the surface treated zinc oxide was changed to 88 nm. The evaluation results of the thus prepared photoconductor of Example 11 are also shown in Tables 1-1 and 1-2.

Example 12

The procedure for preparation and evaluation of the photoconductor of Example 1 was repeated except that the film thickness of the intermediate layer was changed from 22 μm to 12 μm. The evaluation results of the thus prepared photoconductor of Example 12 are also shown in Tables 1-1 and 1-2.

Example 13

The procedure for preparation and evaluation of the photoconductor of Example 1 was repeated except that the film thickness of the intermediate layer was changed from 22 μm to 9 μm. The evaluation results of the thus prepared photoconductor of Example 13 are also shown in Tables 1-1 and 1-2.

Example 14

The procedure for preparation and evaluation of the photoconductor of Example 1 was repeated except that the film thickness of the intermediate layer was changed from 22 μm to 51 μm. The evaluation results of the thus prepared photoconductor of Example 14 are also shown in Tables 1-1 and 1-2.

Example 15

The procedure for preparation and evaluation of the photoconductor of Example 1 was repeated except that the film thickness of the intermediate layer was changed from 22 μm to 48 μm. The evaluation results of the thus prepared photoconductor of Example 15 are also shown in Tables 1-1 and 1-2.

Example 16

The procedure for preparation and evaluation of the photoconductor of Example 1 was repeated except that the Na, Ca and S contents of the surface treated zinc oxide were changed to 89 ppm, 55 ppm and 310 ppm, respectively, and the volume average primary particle diameter of the surface treated zinc oxide was changed to 21 nm. The evaluation results of the thus prepared photoconductor of Example 16 are also shown in Tables 1-1 and 1-2.

Example 17

The procedure for preparation and evaluation of the photoconductor of Example 1 was repeated except that the Na, Ca and S contents of the surface treated zinc oxide were changed to 66 ppm, 47 ppm and 198 ppm, respectively, and the volume average primary particle diameter of the surface treated zinc oxide was changed to 18 nm. The evaluation results of the thus prepared photoconductor of Example 17 are also shown in Tables 1-1 and 1-2.

Example 18

The procedure for preparation and evaluation of the photoconductor of Example 1 was repeated except that the Na, Ca and S contents of the surface treated zinc oxide were changed to 77 ppm, 97 ppm and 106 ppm, respectively, and the volume average primary particle diameter of the surface treated zinc oxide was changed to 192 nm. The evaluation results of the thus prepared photoconductor of Example 18 are also shown in Tables 1-1 and 1-2.

Example 19

The procedure for preparation and evaluation of the photoconductor of Example 1 was repeated except that the Na, Ca and S contents of the surface treated zinc oxide were changed to 52 ppm, 44 ppm and 227 ppm, respectively, and the volume average primary particle diameter of the surface treated zinc oxide was changed to 209 nm. The evaluation results of the thus prepared photoconductor of Example 19 are also shown in Tables 1-1 and 1-2.

Example 20

The procedure for preparation and evaluation of the photoconductor of Example 1 was repeated except that a crosslinkable outermost layer coating liquid having the following formula was applied on the charge transport layer, and the coated outermost layer coating liquid was irradiated with light using a metal halide lamp with a power of 160 W/cm under conditions of 120 mm in irradiation distance, 500 mW/cm$^2$ in irradiance, and 25 seconds in irradiation time, followed by heating (drying) for 20 minutes at 130° C. to form a crosslinked outermost layer on the charge transport layer.

(Formula of Crosslinkable Outermost Layer Coating Liquid)

| | |
|---|---|
| Trimethylolpropane triacrylate serving as radically polymerizable trifunctional monomer having no charge transport structure (KAYARAD TMPTA from Nippon Kayaku Co., Ltd., molecular weight (MW) of 296, number of functional groups (F) of 3, and MW/F ratio of 99) | 10 parts |
| Radically polymerizable monofunctional compound A having no charge transport structure and the following formula | 10 parts |

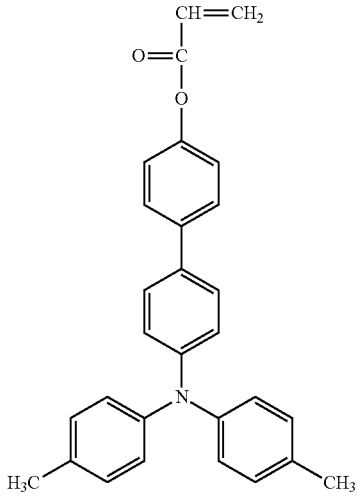

Compound A

| | |
|---|---|
| Photopolymerization initiator (1-hydroxycyclohexyl phenyl ketone (IRGACURE 184 from Ciba Specialty Chemicals (Ciba Japan K.K.)) | 1 part |
| Tetrahydrofuran | 100 parts |

The evaluation results of the thus prepared photoconductor of Example 20 are also shown in Tables 1-1 and 1-2.

Example 21

The procedure for preparation and evaluation of the photoconductor of Example 20 was repeated except that trimethylolpropane triacrylate was replaced with 10 parts of ditrimethylolpropane tetraacrylate (SR-355 from Kayaku Sartomer (Sartomer Japan), molecular weight (MW) of 466, number of functional groups (F) of 4, and MW/F ratio of 117). The evaluation results of the thus prepared photoconductor of Example 21 are also shown in Tables 1-1 and 1-2.

Example 22

The procedure for preparation and evaluation of the photoconductor of Example 20 was repeated except that trimethylolpropane triacrylate was replaced with a mixture of 6 parts of dipentaerythritol hexaacrylate (KAYARAD DPHA from Nippon Kayaku Co., Ltd., molecular weight (MW) of 536, number of functional groups (F) of 5.5, and MW/F ratio of 97) and 4 parts of alkylated dipentaerythritol triacrylate (KAYARAD D-330 from Nippon Kayaku Co., Ltd., molecular weight (MW) of 584, number of functional groups (F) of 3, and MW/F ratio of 195). The evaluation results of the thus prepared photoconductor of Example 22 are also shown in Tables 1-1 and 1-2.

Example 23

The procedure for preparation and evaluation of the photoconductor of Example 20 was repeated except that the radically polymerizable monofunctional compound A was replaced with 10 parts of a radically polymerizable monofunctional compound B having the following formula.

Compound B

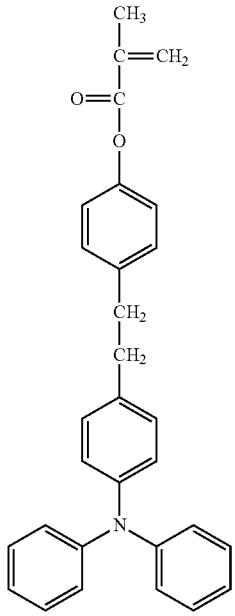

The evaluation results of the thus prepared photoconductor of Example 23 are also shown in Tables 1-1 and 1-2.

Example 24

The procedure for preparation and evaluation of the photoconductor of Example 20 was repeated except that the radically polymerizable monofunctional compound A was replaced with 10 parts of a radically polymerizable monofunctional compound C having the following formula.

Compound C

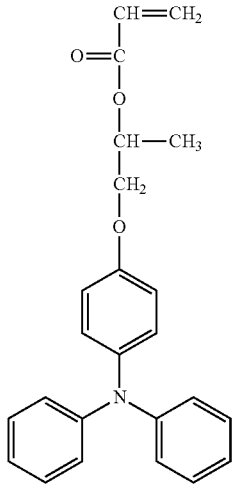

The evaluation results of the thus prepared photoconductor of Example 24 are also shown in Tables 1-1 and 1-2.

Comparative Example 1

The procedure for preparation and evaluation of the photoconductor of Example 1 was repeated except that the Na, Ca and S contents of the surface treated zinc oxide were changed to 2.9 ppm, 0.79 ppm and less than 50 ppm, respectively, and the volume average primary particle diameter of the surface treated zinc oxide was changed to 101 nm. The evaluation results of the thus prepared photoconductor of Comparative Example 1 are also shown in Tables 1-1 and 1-2.

Comparative Example 2

The procedure for preparation and evaluation of the photoconductor of Example 1 was repeated except that the Na, Ca and S contents of the surface treated zinc oxide were changed to 1.8 ppm, 11 ppm and 75 ppm, respectively, and the volume average primary particle diameter of the surface treated zinc oxide was changed to 71 nm. The evaluation results of the thus prepared photoconductor of Comparative Example 2 are also shown in Tables 1-1 and 1-2.

Comparative Example 3

The procedure for preparation and evaluation of the photoconductor of Example 1 was repeated except that the Na, Ca and S contents of the surface treated zinc oxide were changed to 16 ppm, 3.6 ppm and 65 ppm, respectively, and the volume average primary particle diameter of the surface treated zinc oxide was changed to 111 nm. The evaluation results of the thus prepared photoconductor of Comparative Example 3 are also shown in Tables 1-1 and 1-2.

Comparative Example 4

The procedure for preparation and evaluation of the photoconductor of Example 1 was repeated except that the Na, Ca and S contents of the surface treated zinc oxide were changed to 36 ppm, 28 ppm and less than 50 ppm, respectively, and the volume average primary particle diameter of the surface treated zinc oxide was changed to 87 nm. The evaluation results of the thus prepared photoconductor of Comparative Example 4 are also shown in Tables 1-1 and 1-2.

Comparative Example 5

The procedure for preparation and evaluation of the photoconductor of Example 1 was repeated except that the Na, Ca and S contents of the surface treated zinc oxide were changed to 280 ppm, 226 ppm and 518 ppm, respectively, and the volume average primary particle diameter of the surface treated zinc oxide was changed to 96 nm. The evaluation results of the thus prepared photoconductor of Comparative Example 5 are also shown in Tables 1-1 and 1-2.

Comparative Example 6

The procedure for preparation and evaluation of the photoconductor of Example 1 was repeated except that the Na, Ca and S contents of the surface treated zinc oxide were changed to 220 ppm, 66 ppm and 180 ppm, respectively, and the volume average primary particle diameter of the surface treated zinc oxide was changed to 68 nm. The evaluation results of the thus prepared photoconductor of Comparative Example 6 are also shown in Tables 1-1 and 1-2.

Comparative Example 7

The procedure for preparation and evaluation of the photoconductor of Example 1 was repeated except that the Na, Ca and S contents of the surface treated zinc oxide were changed to 180 ppm, 235 ppm and 140 ppm, respectively, and the volume average primary particle diameter of the surface treated zinc oxide was changed to 68 nm. The evaluation results of the thus prepared photoconductor of Comparative Example 7 are also shown in Tables 1-1 and 1-2.

Comparative Example 8

The procedure for preparation and evaluation of the photoconductor of Example 1 was repeated except that the Na, Ca and S contents of the surface treated zinc oxide were changed to 110 ppm, 196 ppm and 550 ppm, respectively, and the volume average primary particle diameter of the surface treated zinc oxide was changed to 68 nm. The evaluation results of the thus prepared photoconductor of Comparative Example 8 are also shown in Tables 1-1 and 1-2.

TABLE 1-1

| | Na content (ppm) | Ca content (ppm) | S content (ppm) | Elastic deformation rate (τe) (%) | Standard deviation of elastic deformation rate (%) | Abrasion loss (μm) |
|---|---|---|---|---|---|---|
| Ex. 1 | 54 | 47 | 250 | 27.7 | 0.71 | 3.5 |
| Ex. 2 | 94 | 46 | 160 | 27.2 | 0.73 | 3.4 |
| Ex. 3 | 87 | 140 | 86 | 27.4 | 0.74 | 3.5 |
| Ex. 4 | 15 | 55 | 216 | 27.5 | 0.74 | 3.6 |
| Ex. 5 | 90 | 14 | 130 | 27.3 | 0.71 | 3.7 |
| Ex. 6 | 62 | 51 | 54 | 27.6 | 0.76 | 3.2 |
| Ex. 7 | 189 | 120 | 290 | 27.8 | 0.72 | 3.6 |
| Ex. 8 | 53 | 194 | 168 | 27.5 | 0.74 | 3.6 |
| Ex. 9 | 98 | 110 | 489 | 27.4 | 0.74 | 3.5 |
| Ex. 10 | 65 | 49 | 184 | 27.6 | 0.76 | 3.3 |
| Ex. 11 | 68 | 46 | 290 | 27.4 | 0.75 | 3.5 |
| Ex. 12 | 54 | 47 | 250 | 27.5 | 0.76 | 3.4 |
| Ex. 13 | 54 | 47 | 250 | 27.6 | 0.71 | 3.5 |
| Ex. 14 | 54 | 47 | 250 | 27.4 | 0.72 | 3.6 |
| Ex. 15 | 54 | 47 | 250 | 27.7 | 0.74 | 3.6 |
| Ex. 16 | 89 | 55 | 310 | 27.4 | 0.72 | 3.6 |
| Ex. 17 | 66 | 47 | 198 | 27.4 | 0.74 | 3.4 |
| Ex. 18 | 77 | 97 | 106 | 27.6 | 0.71 | 3.7 |
| Ex. 19 | 52 | 44 | 227 | 27.4 | 0.72 | 3.6 |
| Ex. 20 | 54 | 47 | 250 | 42.0 | 0.85 | 0.6 |
| Ex. 21 | 54 | 47 | 250 | 40.8 | 1.44 | 0.7 |
| Ex. 22 | 54 | 47 | 250 | 46.2 | 0.79 | 0.9 |
| Ex. 23 | 54 | 47 | 250 | 44.5 | 0.98 | 1.1 |
| Ex. 24 | 54 | 47 | 250 | 35.8 | 0.67 | 0.8 |
| Comp. Ex. 1 | 2.9 | 0.79 | <50 | 27.3 | 0.72 | 3.7 |
| Comp. Ex. 2 | 1.8 | 11 | 75 | 27.4 | 0.72 | 3.6 |
| Comp. Ex. 3 | 16 | 3.6 | 65 | 27.4 | 0.74 | 3.5 |
| Comp. Ex. 4 | 36 | 28 | <50 | 27.4 | 0.72 | 3.6 |
| Comp. Ex. 5 | 280 | 226 | 518 | 27.5 | 0.74 | 3.6 |
| Comp. Ex. 6 | 220 | 66 | 180 | 27.6 | 0.76 | 3.3 |
| Comp. Ex. 7 | 180 | 235 | 140 | 27.4 | 0.72 | 3.6 |
| Comp. Ex. 8 | 110 | 196 | 550 | 27.5 | 0.74 | 3.6 |

TABLE 1-2

| | Na content | Ca content | S content | Initial potential (-V) | | Potential after 50,000 cycles of charging and irradiation (-V) | | Increase in VL (V) | Image quality | |
|---|---|---|---|---|---|---|---|---|---|---|
| | (ppm) | (ppm) | (ppm) | V 0 | VL | V 0' | VL' | ΔVL | BF* | ID** |
| Ex. 1 | 54 | 47 | 250 | 709 | 56 | 700 | 88 | 32 | ○ | ○ |
| Ex. 2 | 94 | 46 | 160 | 705 | 55 | 712 | 79 | 24 | ○ | ○ |
| Ex. 3 | 87 | 140 | 86 | 703 | 56 | 723 | 83 | 27 | ○ | ○ |
| Ex. 4 | 15 | 55 | 216 | 704 | 80 | 713 | 118 | 38 | ○ | ○ |

TABLE 1-2-continued

| | Na content (ppm) | Ca content (ppm) | S content (ppm) | Initial potential (-V) V 0 | Initial potential (-V) VL | Potential after 50,000 cycles of charging and irradiation (-V) V 0' | Potential after 50,000 cycles of charging and irradiation (-V) VL' | Increase in VL (V) ΔVL | Image quality BF* | Image quality ID** |
|---|---|---|---|---|---|---|---|---|---|---|
| Ex. 5 | 90 | 14 | 130 | 710 | 89 | 724 | 100 | 11 | ○ | ○ |
| Ex. 6 | 62 | 51 | 54 | 701 | 89 | 737 | 123 | 34 | ○ | ○ |
| Ex. 7 | 189 | 120 | 290 | 703 | 40 | 674 | 54 | 14 | ○ | ○ |
| Ex. 8 | 53 | 194 | 168 | 704 | 46 | 666 | 58 | 12 | ○ | ○ |
| Ex. 9 | 98 | 110 | 489 | 705 | 37 | 680 | 58 | 21 | ○ | ○ |
| Ex. 10 | 65 | 49 | 184 | 704 | 73 | 734 | 112 | 39 | ○ | ○ |
| Ex. 11 | 68 | 46 | 290 | 706 | 65 | 740 | 75 | 10 | ○ | ○ |
| Ex. 12 | 54 | 47 | 250 | 699 | 55 | 732 | 77 | 22 | ○ | ○ |
| Ex. 13 | 54 | 47 | 250 | 704 | 47 | 731 | 65 | 18 | ○ | ○ |
| Ex. 14 | 54 | 47 | 250 | 700 | 78 | 711 | 88 | 10 | ○ | ○ |
| Ex. 15 | 54 | 47 | 250 | 697 | 69 | 721 | 79 | 10 | ○ | ○ |
| Ex. 16 | 89 | 55 | 310 | 720 | 48 | 703 | 62 | 14 | ○ | ○ |
| Ex. 17 | 66 | 47 | 198 | 704 | 47 | 731 | 83 | 36 | ○ | ○ |
| Ex. 18 | 77 | 97 | 106 | 708 | 53 | 711 | 69 | 16 | ○ | ○ |
| Ex. 19 | 52 | 44 | 227 | 698 | 82 | 721 | 110 | 28 | ○ | ○ |
| Ex. 20 | 54 | 47 | 250 | 710 | 92 | 702 | 97 | 5 | ○ | ○ |
| Ex. 21 | 54 | 47 | 250 | 704 | 91 | 702 | 99 | 8 | ○ | ○ |
| Ex. 22 | 54 | 47 | 250 | 708 | 96 | 706 | 100 | 4 | ○ | ○ |
| Ex. 23 | 54 | 47 | 250 | 704 | 93 | 702 | 100 | 7 | ○ | ○ |
| Ex. 24 | 54 | 47 | 250 | 705 | 94 | 704 | 97 | 3 | ○ | ○ |
| Comp. Ex. 1 | 2.9 | 0.79 | <50 | 707 | 155 | 700 | 355 | 200 | ○ | X |
| Comp. Ex. 2 | 1.8 | 11 | 75 | 710 | 112 | 775 | 314 | 202 | ○ | X |
| Comp. Ex. 3 | 16 | 3.6 | 65 | 706 | 136 | 783 | 180 | 44 | ○ | X |
| Comp. Ex. 4 | 36 | 28 | <50 | 704 | 66 | 769 | 368 | 302 | ○ | X |
| Comp. Ex. 5 | 280 | 226 | 518 | 692 | 57 | 470 | 38 | −19 | X | ○ |
| Comp. Ex. 6 | 220 | 66 | 180 | 709 | 65 | 640 | 44 | −21 | X | ○ |
| Comp. Ex. 7 | 180 | 235 | 140 | 708 | 72 | 621 | 36 | −36 | X | ○ |
| Comp. Ex. 8 | 110 | 196 | 550 | 701 | 68 | 504 | 400 | 332 | X | ○ |

BF*: Background fog
ID**: Image density

It is clear from Tables 1-1 and 1-2 that the photoconductors of Examples 1-24 in which the Na, Ca and S contents of the zinc oxide included in the intermediate layer fall inside the proper ranges have a good combination of the background fog property and the image density property even after long repeated use, but the photoconductors of Comparative Examples 1-8 in which at least one of the Na, Ca and S contents of the zinc oxide included in the intermediate layer falls outside the proper range have poor background fog property or image density property. In addition, the photoconductors of Examples 20-24 which include a crosslinked outermost layer having an elastic deformation rate (τe) of not less than 35% with a standard deviation of not greater than 2% have better electric properties and abrasion resistance.

It can be clearly understood from the above description that the photoconductor of this disclosure hardly increases the potential of an irradiated portion while hardly deteriorating the charging property, resulting in prevention of decrease of image density, occurrence of background fog, and formation of uneven images in a continuous image forming operation.

Additional modifications and variations of the present invention are possible in light of the above teachings. It is therefore to be understood that within the scope of the appended claims the invention may be practiced other than as specifically described herein.

What is claimed is:

1. A photoconductor comprising:

an electroconductive substrate;

an intermediate layer located overlying the electroconductive substrate; and a photosensitive layer located overlying the intermediate layer, wherein the intermediate layer includes at least a resin, and a particulate zinc oxide, wherein the particulate zinc oxide includes sodium, sulfur and calcium in amounts of from 10 ppm to 200 ppm, from 50 ppm to 500 ppm, and from 10 ppm to 200 ppm, respectively.

2. The photoconductor according to claim 1, wherein a surface of the particulate zinc oxide is treated with a silane coupling agent.

3. The photoconductor according to claim 2, wherein the silane coupling agent includes an amino group.

4. The photoconductor according to claim 1, wherein the intermediate layer has a film thickness of not less than 10 μm and less than 50 μm.

5. The photoconductor according to claim 1, wherein the particulate zinc oxide has a volume average primary particle diameter of from 20 nm to 200 nm.

6. The photoconductor according to claim 1, further comprising:

a crosslinked outermost layer located overlying the photosensitive layer, wherein the crosslinked outermost layer includes a crosslinked material including at least a unit of a radically polymerizable tri- or more-functional monomer having no charge transport structure and another unit of a radically polymerizable monofunctional compound having a charge transport structure, and wherein the crosslinked outermost layer has an elastic deformation rate ($\tau e$) of not less than 35% with a standard deviation of not greater than 2%.

7. An image forming method comprising:

charging a surface of the photoconductor according to claim 1;

irradiating the charged surface of the photoconductor with light to form an electrostatic latent image on the surface of the photoconductor;

developing the electrostatic latent image with a developer including a toner to form a toner image on the surface of the photoconductor; and transferring the toner image onto a recording medium.

8. An image forming apparatus comprising:

the photoconductor according to claim 1;

a charger to charge a surface of the photoconductor;

an irradiator to irradiate the charged surface of the photoconductor with light to form an electrostatic latent image on the surface of the photoconductor;

a developing device to develop the electrostatic latent image with a developer including a toner to form a toner image on the surface of the photoconductor; and a transferring device to transfer the toner image onto a recording medium.

9. A process cartridge comprising:

the photoconductor according to claim 1; and at least one of a charger to charge a surface of the photoconductor, an irradiator to irradiate the charged surface of the photoconductor with light to form an electrostatic latent image on the surface of the photoconductor, a developing device to develop the electrostatic latent image with a developer including a toner to form a toner image on the surface of the photoconductor, a transferring device to transfer the toner image onto a recording medium, a cleaner to clean the surface of the photoconductor after the toner image is transferred to the recording medium, and a discharger to remove residual charges from the surface of the photoconductor after the toner image is transferred to the recording medium, wherein the process cartridge is detachably attachable to an image forming apparatus as a single unit.

* * * * *